US007124120B2

(12) United States Patent
Wikiel et al.

(10) Patent No.: US 7,124,120 B2
(45) Date of Patent: Oct. 17, 2006

(54) METHOD AND APPARATUS FOR REAL TIME MONITORING OF ELECTROPLATING BATH PERFORMANCE AND EARLY FAULT DETECTION

(75) Inventors: Kazimierz J. Wikiel, South Kingstown, RI (US); Aleksander Jaworski, Warwick, RI (US); Hanna Wikiel, South Kingstown, RI (US)

(73) Assignee: Technic, Inc., Cranston, RI (US)

( * ) Notice: Subject to any disclaimer, the term of this patent is extended or adjusted under 35 U.S.C. 154(b) by 471 days.

(21) Appl. No.: 10/621,079

(22) Filed: Jul. 16, 2003

(65) Prior Publication Data

US 2004/0055888 A1 Mar. 25, 2004

Related U.S. Application Data

(60) Provisional application No. 60/397,133, filed on Jul. 19, 2002.

(51) Int. Cl.
*G06N 3/08* (2006.01)
*G01N 27/48* (2006.01)

(52) U.S. Cl. ..... 706/10; 205/775

(58) Field of Classification Search ..... 706/10
See application file for complete search history.

(56) References Cited

U.S. PATENT DOCUMENTS 5,368,715 A 11/1994 Hurley et al.
6,365,033 B1 4/2002 Graham et al.
6,391,477 B1 * 5/2002 Koslov et al. ..... 428/670
6,471,845 B1 10/2002 Dukovic et al.

OTHER PUBLICATIONS

H.S. Manwaring, The Use of an Artificial Neural Network to Improve Precision□□in Trace Level, Quantitative Analysis of Heavy Metal Pollutants, 1995, 'Artificial Nerrral Networks' Jun. 26-28, 1996 Conference Publication No. 409 copyright IEE 1995.*

Sinnasamy R. Naidu et al., Use of Neural Networks for Sensor Failure Detection in a Control System, Apr. 1990, IEEE Control Systems Magazine.*

T. W. Simpson et al., Metamodels for Computer-based Engineering Design: Survey and□□recommendations, 2001, Engineering with Computers (2001) 17: 129-150, Springer-Verlag London Limited.*

Glenn J. Battaglia, Regression-Based Statistical Process Control, 1993, AMP Journal of Technology vol. 3 Nov. 1993.*

Plotech, Manufacturing Process Standardization, 2001, Copyright(C) 2001 Plotech. All rights reserved.*

(Continued)

*Primary Examiner*—Anthony Knight
*Assistant Examiner*—Nathan H. Brown, Jr.

(57) ABSTRACT

The present invention relates generally to any plating solution and methods for monitoring its performance. More specifically, the present invention relates to plating bath and methods for monitoring its plating functionality based on chemometric analysis of voltammetric data obtained for these baths. More particularly, the method of the present invention relates to application of numerous chemometric techniques to describe quantitatively plating bath functionality in order to maintain its proper performance.

33 Claims, 12 Drawing Sheets

Hull cell panels (2A, 5 min.) obtained from the pure PC 75 bath (A) and after addition of 200 ppm of TEG.

OTHER PUBLICATIONS

N.C. Division of Pollution Prevention and Environmental Assistance, Metal Finishing Industry, Pollution Prevention in the Plating Process (http://www.p2pays.org/ref/03/02454/plating.htm), Jul. 11, 2002.*

Gottfried Rudorfer, Early Bankruptcy Detection Using Neural Networks, 1995, APL Quote Quad, ACM New York, vol. 25, No. 4, Jun. 1995, pp. 171-178.*

Ormoneit et al., "Learning and Tracking Human Motion Using Functional Analysis", 2000, Proc. IEEE Workshop on Human Modeling, Analysis and Synthesis, Hilton Head, SC, Jun. 2000., (c) IEEE 2000.*

Jordanov et al., A study of the morphological aspects of the indium electrorefining process, 2001, J. Serb.Chem.Soc. 66(11-12)913-921(2001).*

K. K. H. Wong et al., Metallization by plating for high-performance multichip modules, (http://www.research.ibm.com/journal/rd/425/wong.html), 1998, IBM Journal of Research and Development.*

Dietz, K., "Fine Lines in High Yield (Part LIII): Organic Additives in Copper Plating Baths (Part II)", CircuTree, 13(3), 2000, 54.

Moffat, T. P., et al. "Superconformal Electrodeposition of Copper in 500-90 nm Features", Journal of the Electrochemical Society, 147 (12), 4524-4535, 2000.

Moffat, T. P., et al. "Superconformal Electrodeposition of Copper", Electrochemical and Solid-State Letters, 4 (4), C26-C29, 2001.

Moffat, T. P., et al. "Superconformal Electrodeposition in Sumbicron Features", Phys. Rev. Lett., 87, 2001, 16102.

Josell, D., et al. "A Simple Equation for Predicting Superconformal Electrodeposition in Sumbmicrometer Trenches", Journal of the Electrochemical Society, 148 (12), C767-C773, 2001.

Dietz, K., "Fine Lines in High Yield (Part LIV): Organic Additives in Copper Plating Baths (Part 1a)", CircuTree, 13(2), 2000, 22.

Shah, et al., "Combination of the Mahalanobis Distance and Residual Variance Pattern Recognition Techniques for Classification of Near-Infrared Reflectance Spectra", Anal. Chem., 1990, 62, 465-470.

* cited by examiner

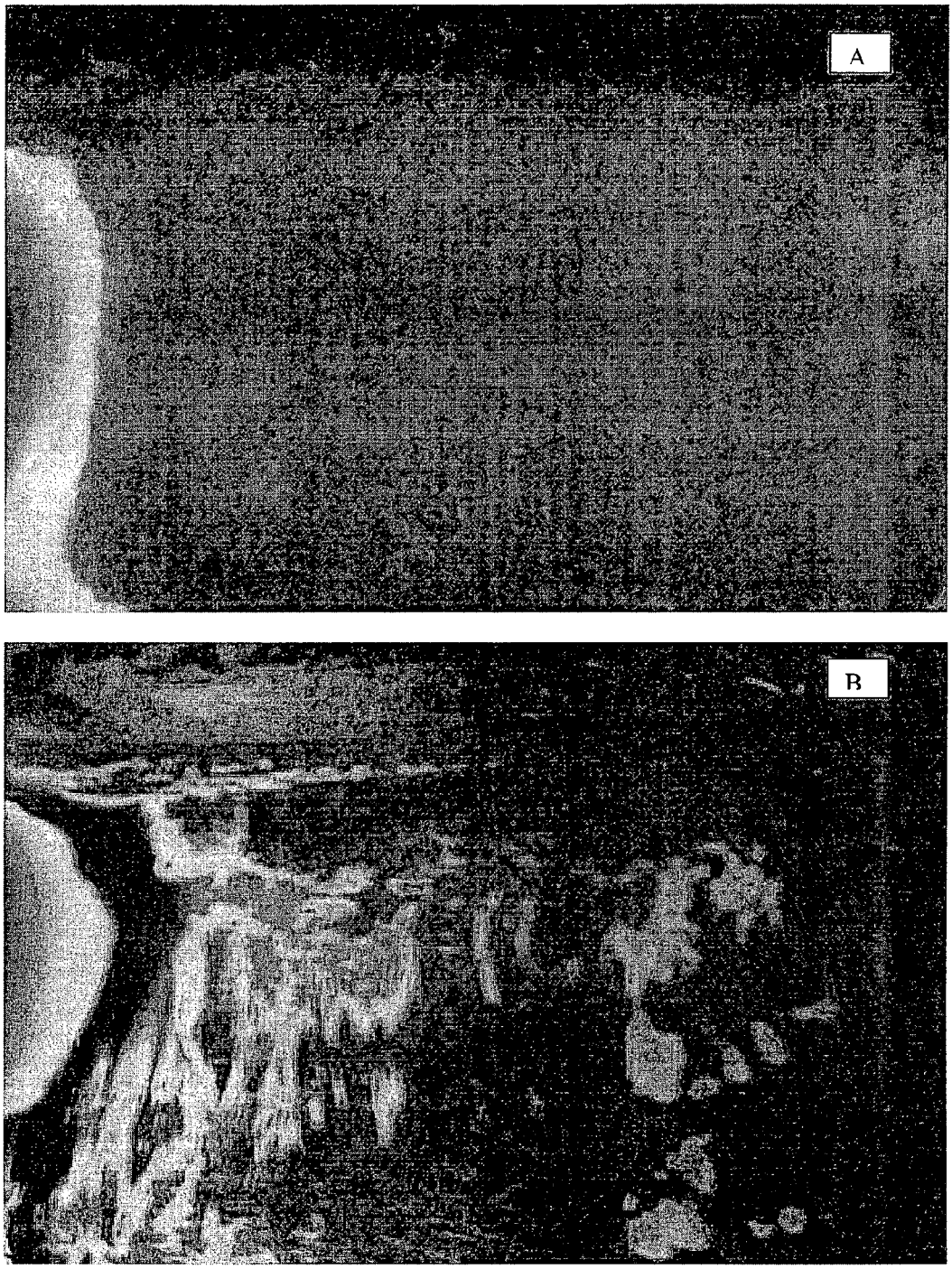
Figure 1. Hull cell panels (2A, 5 min.) obtained from the pure PC 75 bath (A) and after addition of 200 ppm of TEG.

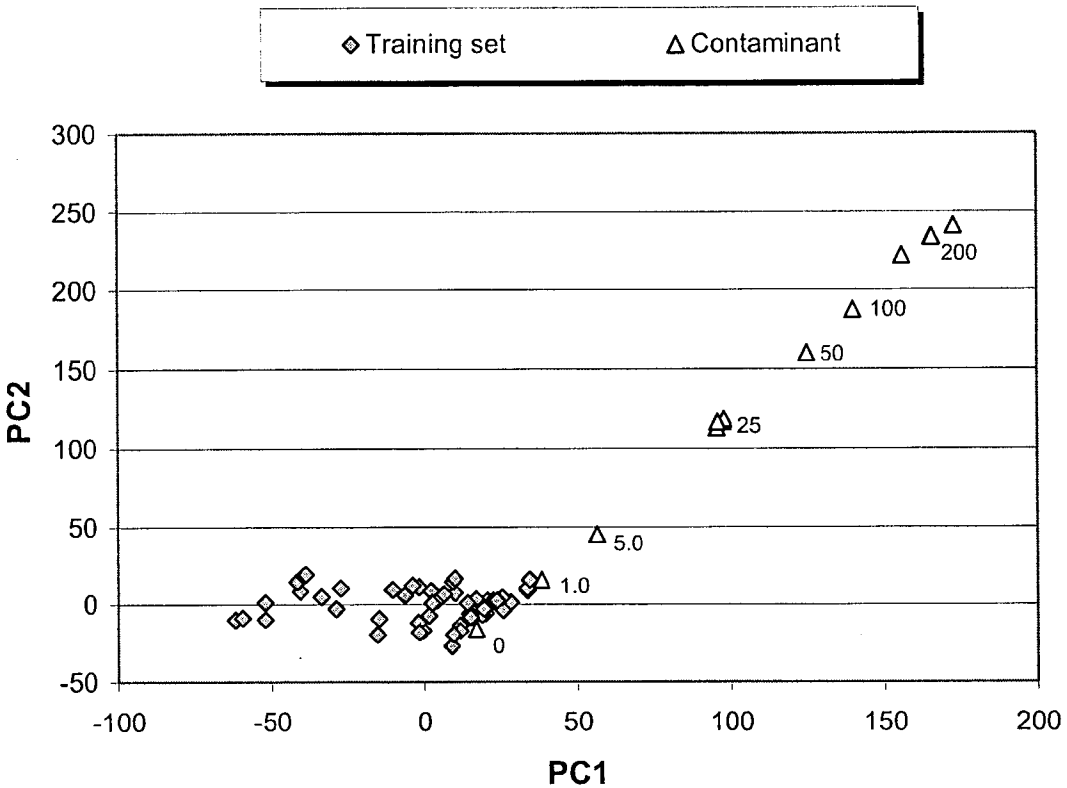
Figure 2. Plot of first principal components versus second principal components. Training set solutions diamonds; bath samples contaminated with TEG: triangles (numbers –concentration of TEG in ppm). Scan dq21cr2, channel 3, 300-1200, 4 factors.

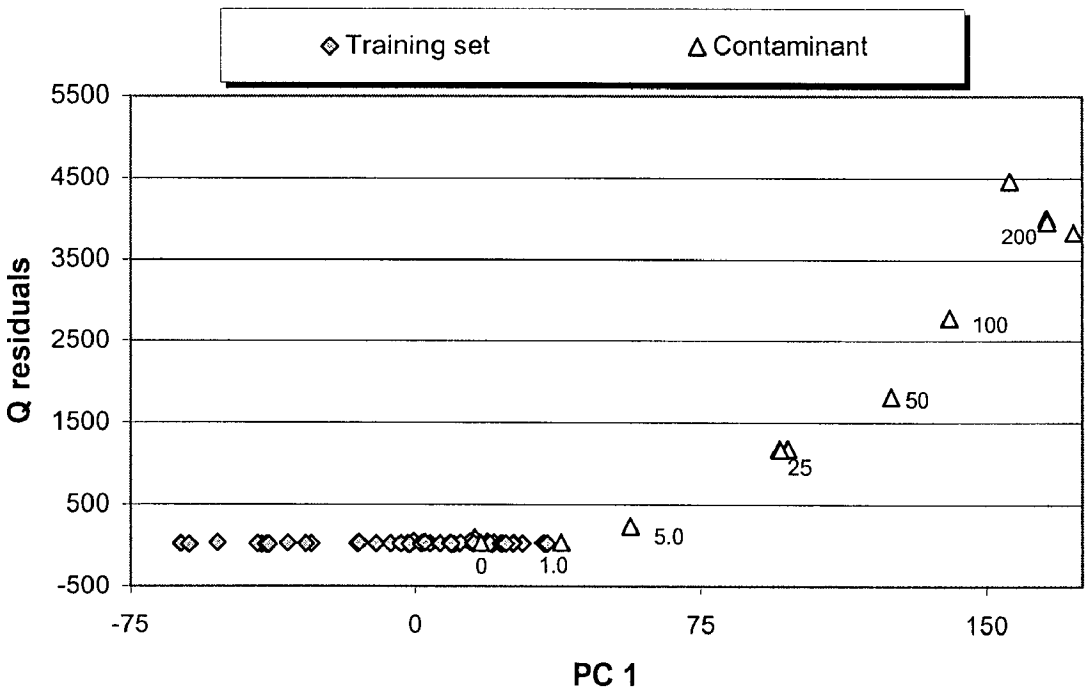
Figure 3. Plot of first principal components versus Q residuals. Training set solutions: diamonds; bath samples contaminated with TEG: triangles (numbers –concentration of TEG in ppm). Scan dq21cr2, channel 3, 300-1200, 4 factors.

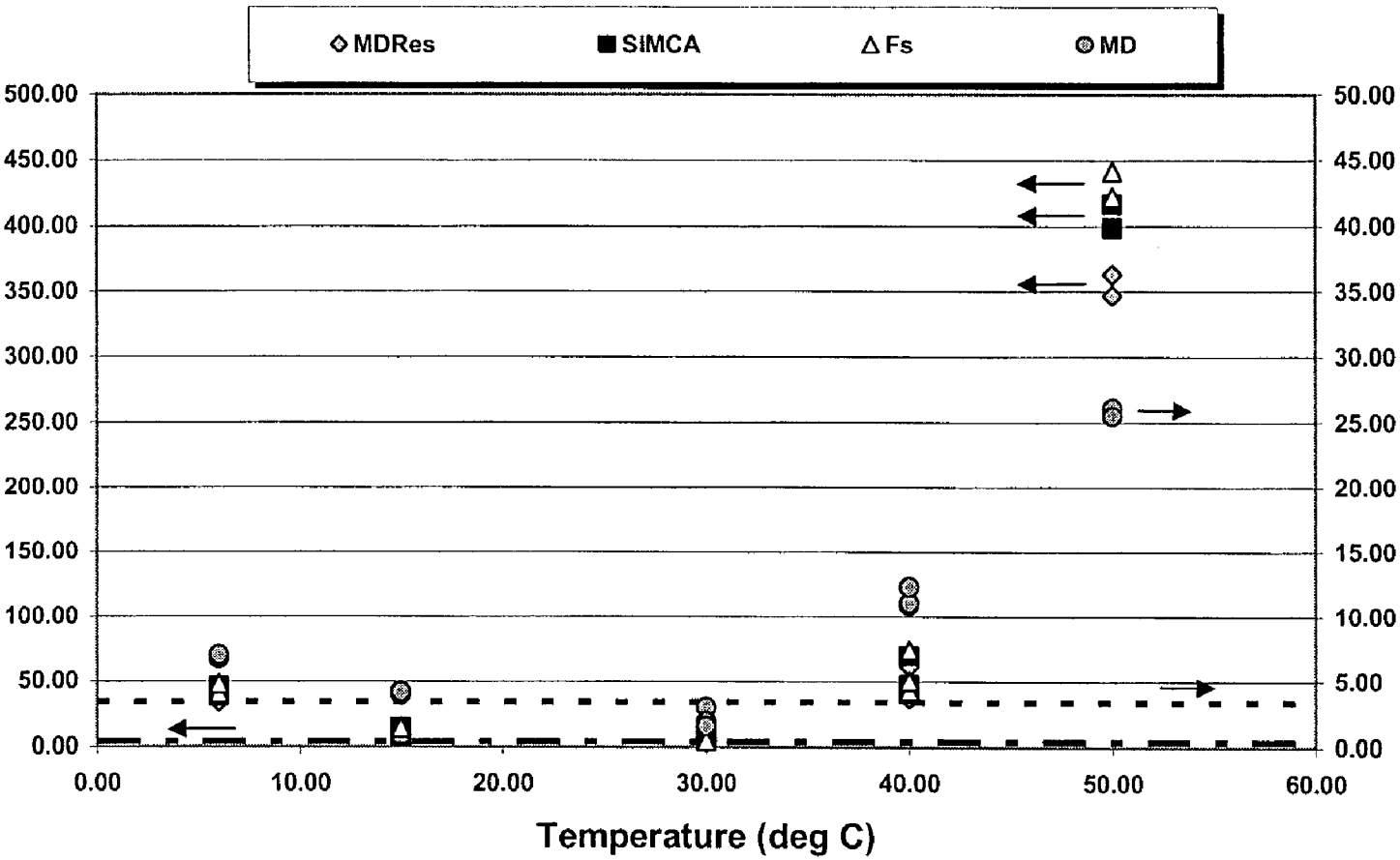
Figure 4. Plot of all outlier qualifiers versus temperature for the PC 75 copper bath.

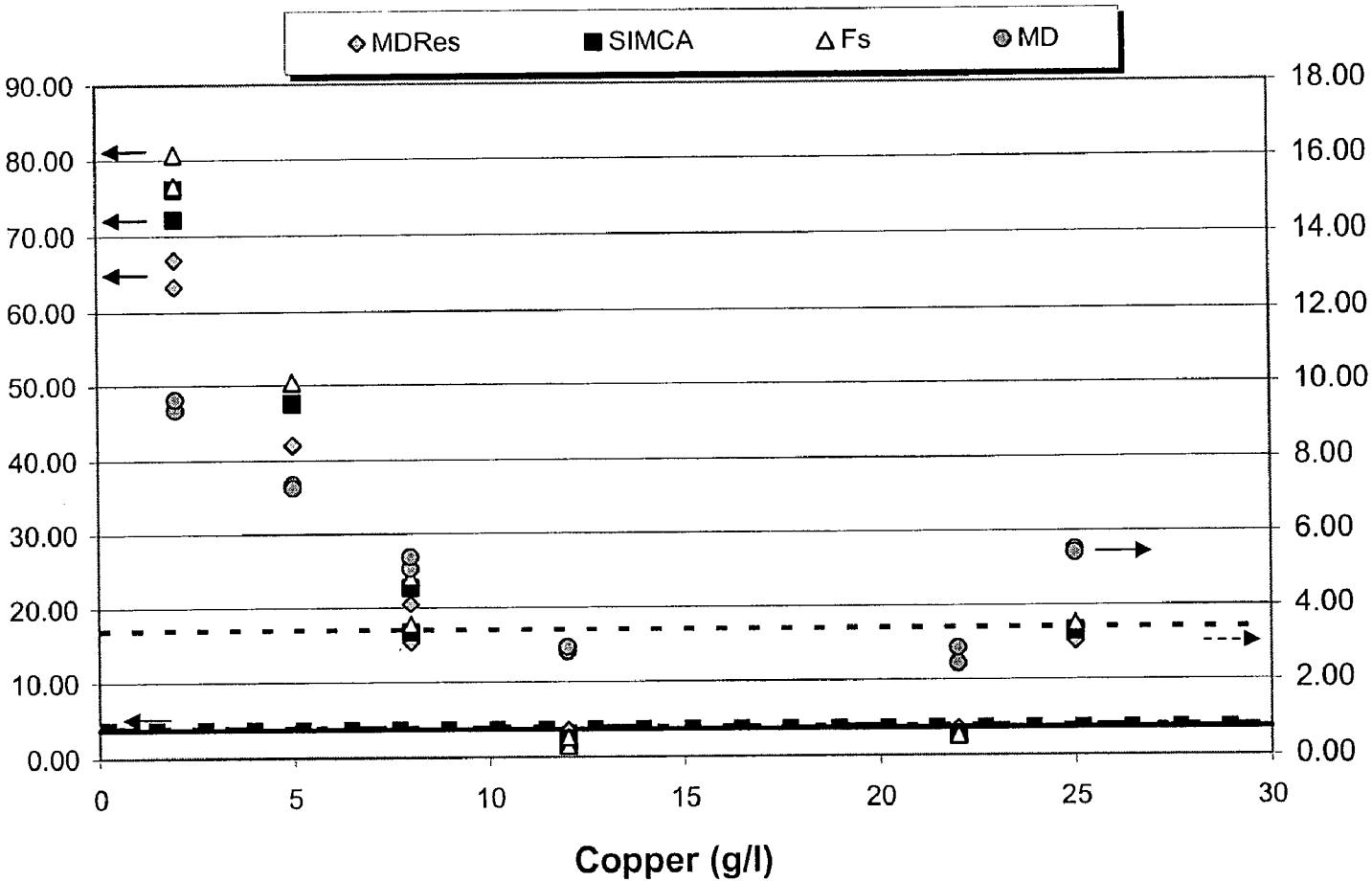
Figure 5. Plot of all outlier qualifiers versus copper concentration for PC 75 copper bath.

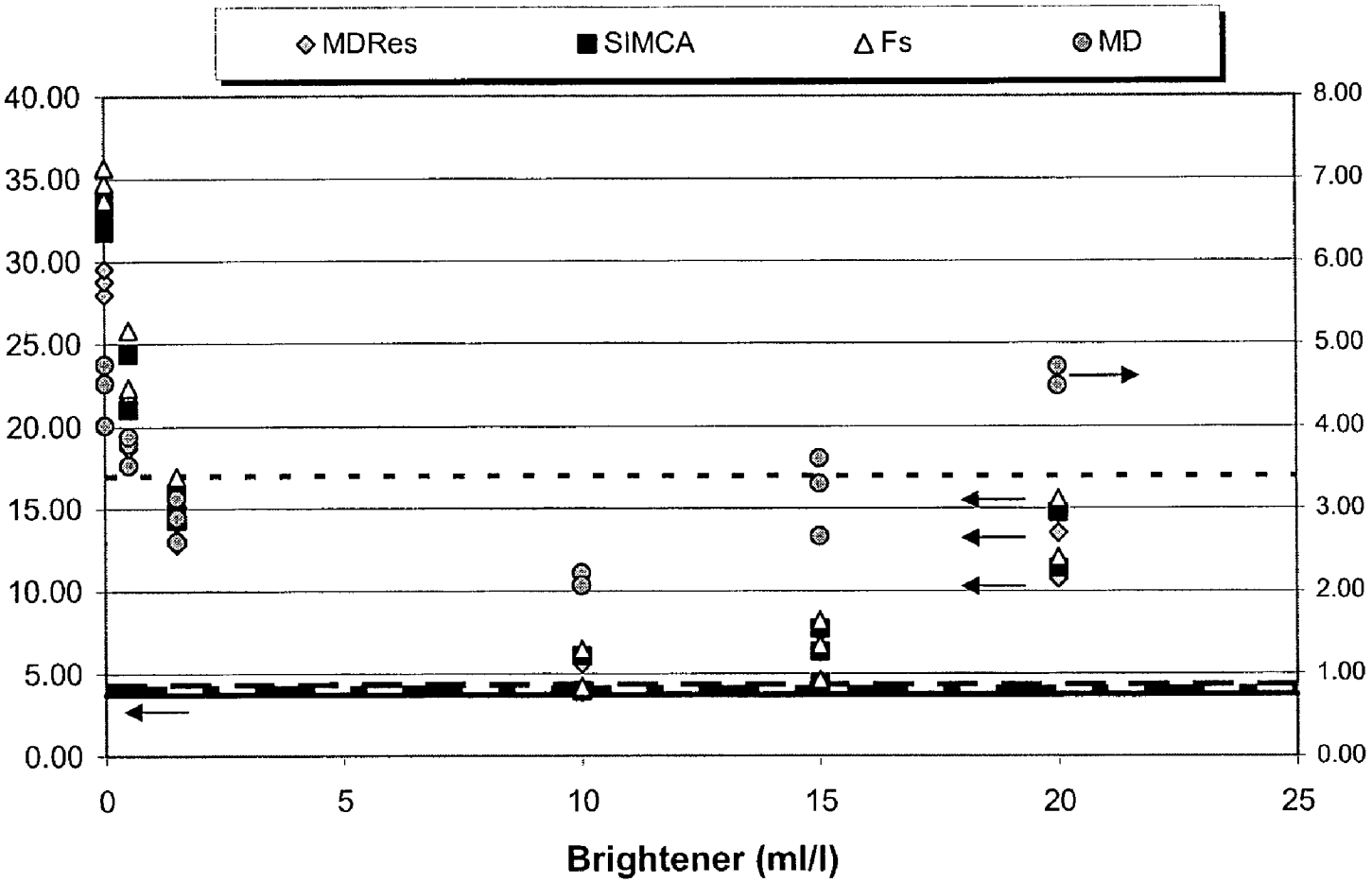
Figure 6. Plot of all outlier qualifiers versus brightener concentration for PC 75 copper bath.

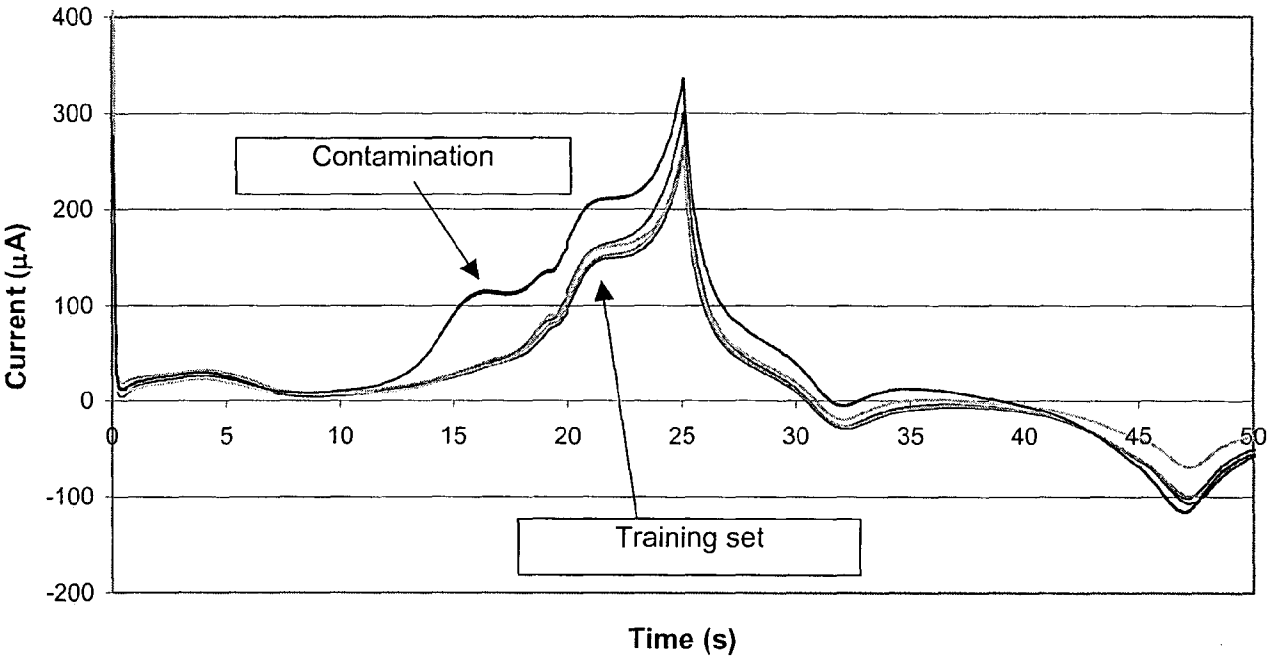
Figure 7. Voltammograms for solutions from industrial training set and an industrial sample contaminated with $H_2O_2$.

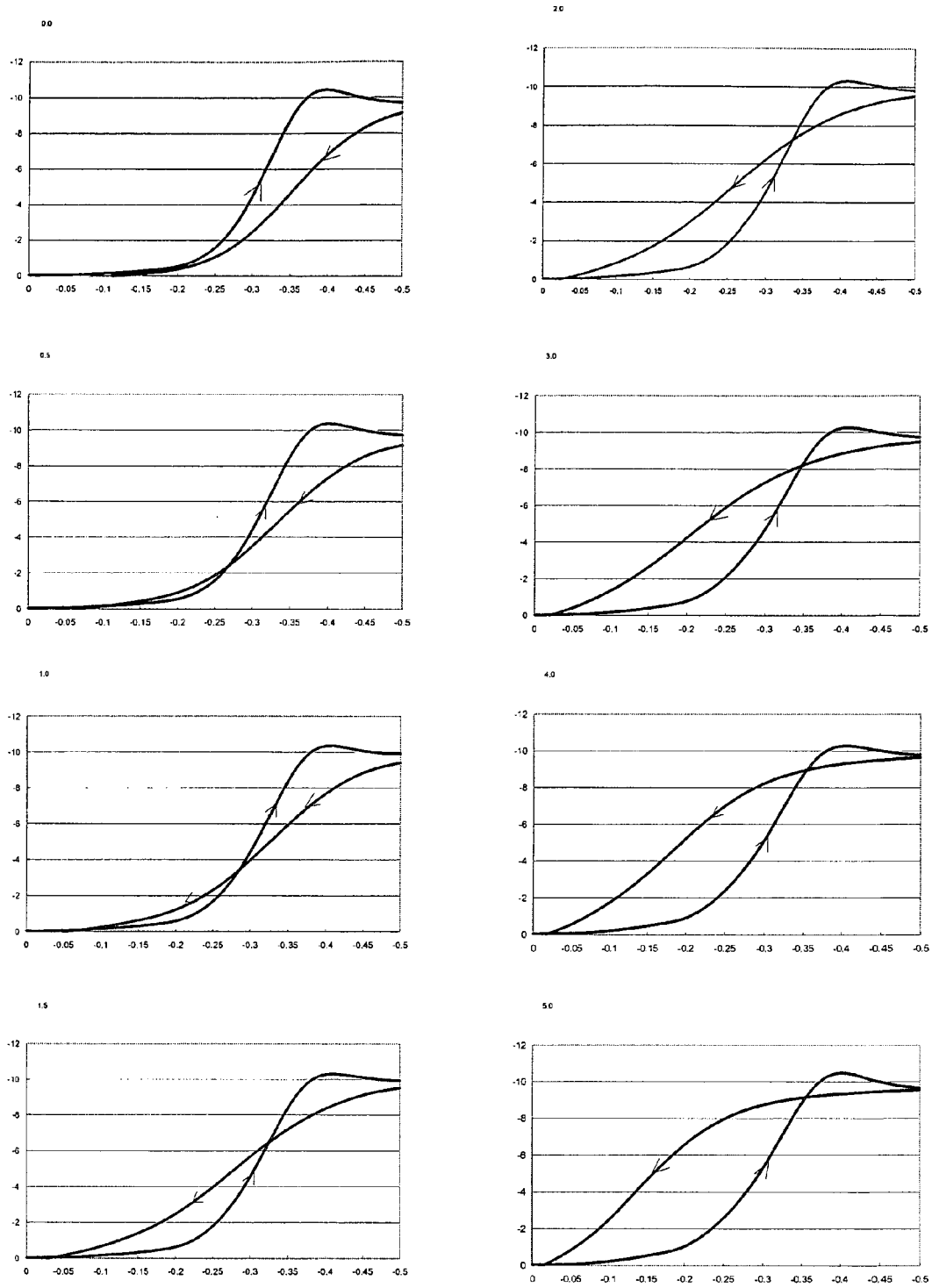
Figure 8. Voltammograms for PC 75 copper bath showing a hysteresis in copper reduction for various concentration of brightener.

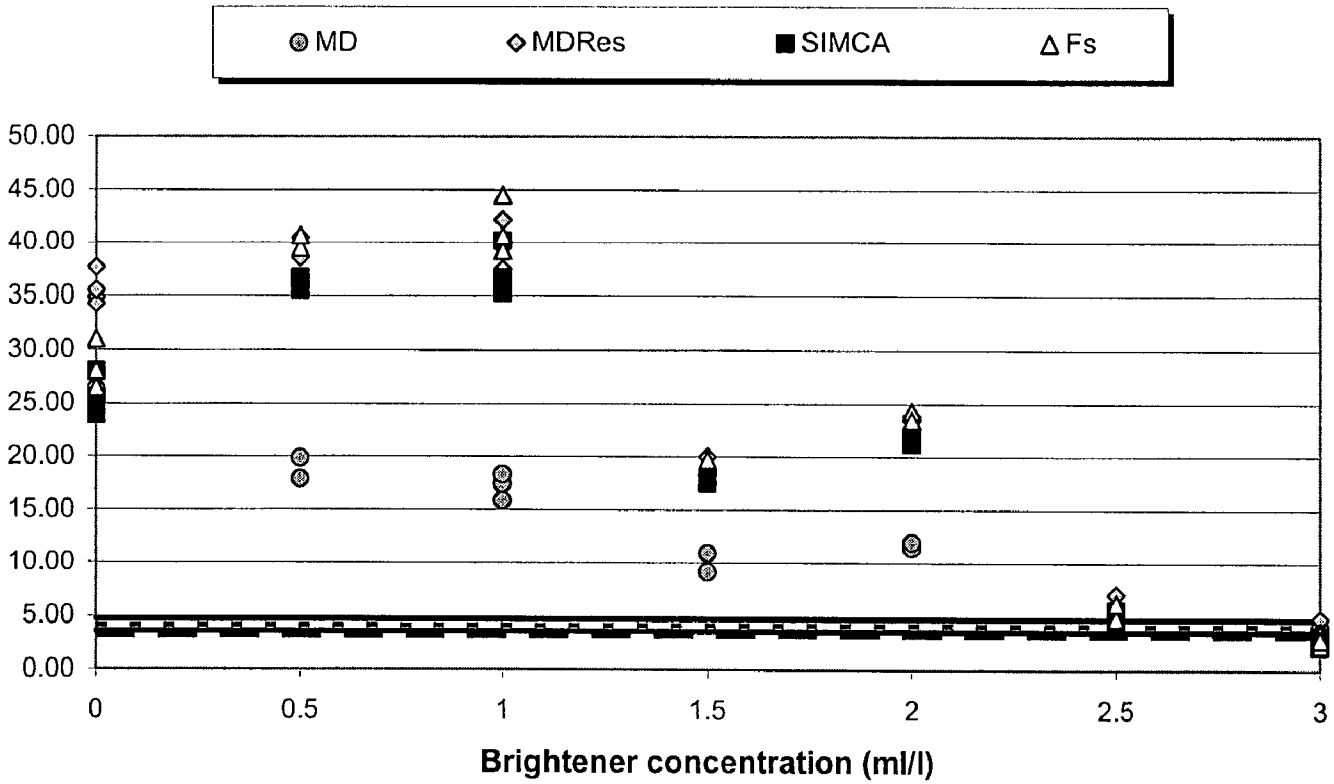
Figure 9. Plot of all outlier qualifiers for hysteresis in PC75 bath versus concentration of brightener in solution.

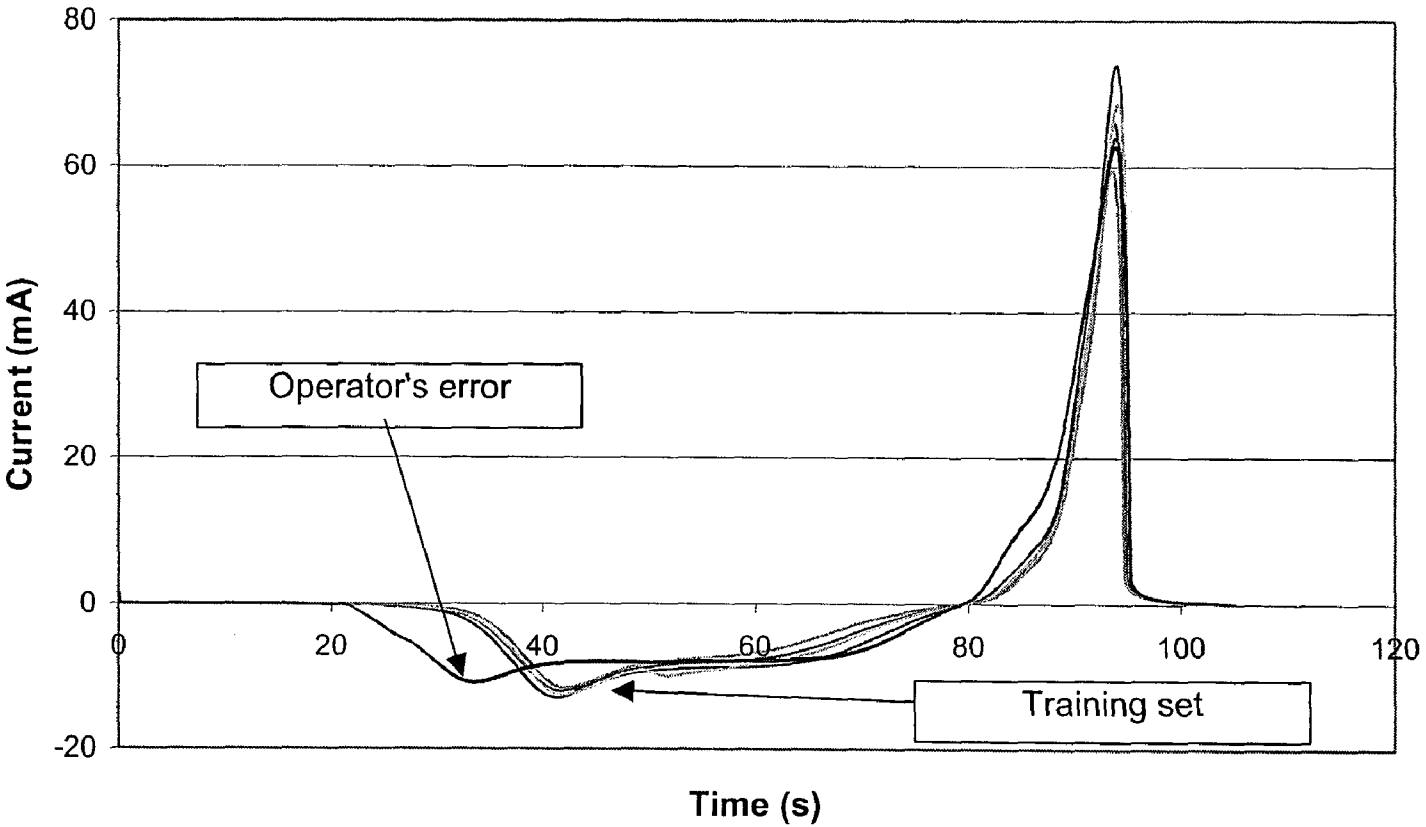
Figure 10. Voltammograms for solutions from training set and a solution that was replenished improperly.

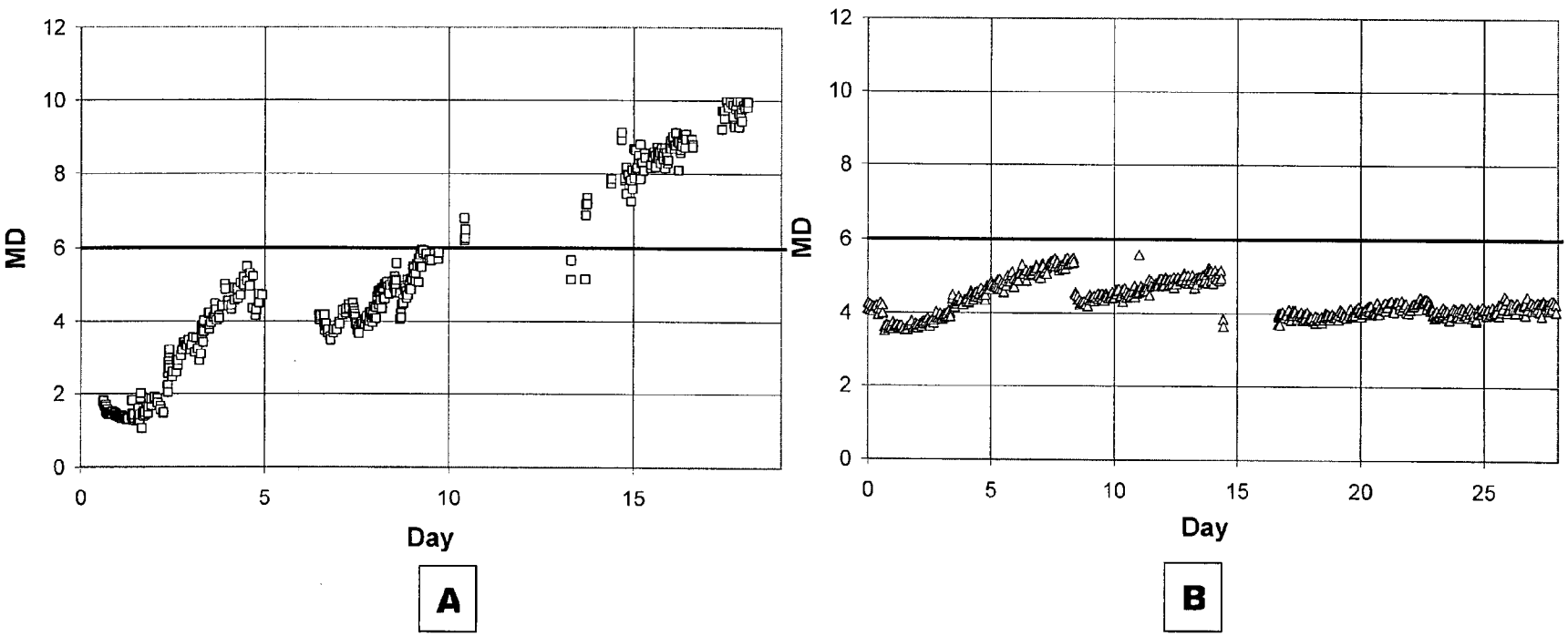
Figure 11. Plot of MD values for copper reduction in industrial solution with passive consumption (A – no plating, circulation only), and industrial solution with active consumption and with feed and bleed (B - plating).

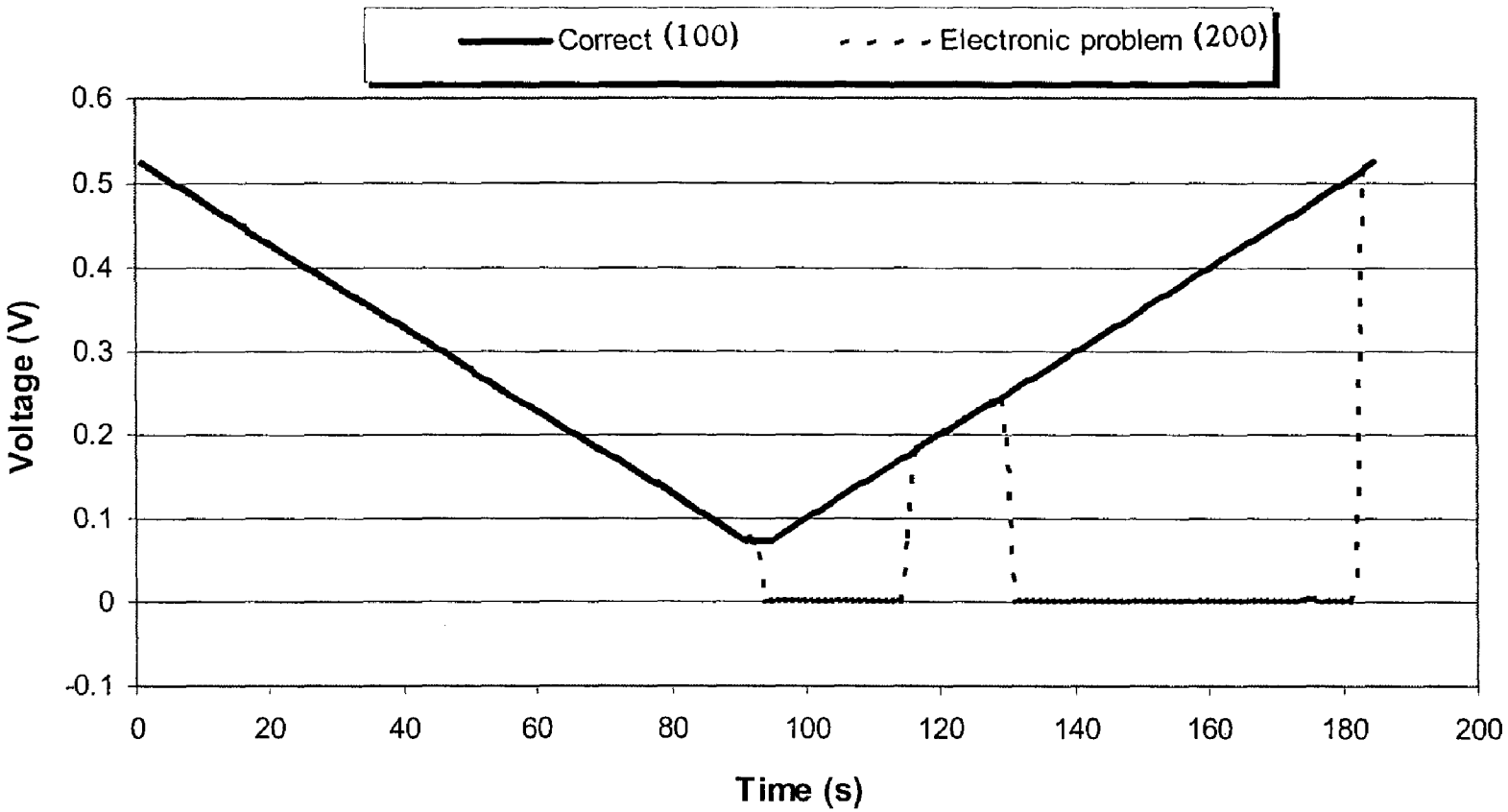
Figure 12. Voltage time plot for a typical (100) and faulty (200) electronic conditions of the measuring system.

METHOD AND APPARATUS FOR REAL TIME MONITORING OF ELECTROPLATING BATH PERFORMANCE AND EARLY FAULT DETECTION

PRIORITY CLAIM

This application claims priority from commonly owned, copending U.S. Provisional Application Serial No. 60/397,133, filed 19 Jul. 2002, the disclosure of which is hereby incorporated herein by reference.

FIELD OF THE INVENTION

The present invention relates generally to any plating solution and methods for monitoring its performance. More specifically, the present invention relates to plating baths and methods for monitoring their plating functionality based on chemometric analysis of voltammetric data obtained for these baths. More particularly, the method of the present invention relates to the application of numerous chemometric techniques to describe quantitatively plating bath functionality in order to maintain proper performance of the baths.

BACKGROUND OF THE INVENTION

Sources of Improper Performance of Plating Bath

A typical plating bath solution comprises a combination of several different chemical constituents. The specific constituents vary depending upon the type of plating bath. The concentration levels of the constituents are important determinants of the quality of the resultant plating deposit. The characteristics of the plating deposit, including tensile strength, ductility, solderability, uniformity, brightness and resistance to thermal shock, depend on concentrations of constituents. Should the constituents fall outside of required concentration ranges, however, the bath may fail to satisfactorily perform its plating function. It is therefore important that deliberately added constituent concentrations are regularly and accurately monitored. Current techniques for plating bath components analysis, recently reviewed by Wikiel et al. [1], do not employ reliable calibration methods employing multivariate data analysis capable of detecting outliers.

Unfortunately, most organic additives undergo degradation reactions, which lead not only to the depletion of their concentration but also to the introduction of degradation products in the plating bath. These degradation products accumulate and some of them impede the performance of plating bath. The degradation of polyoxyethylene-based surfactants (like the carrier in a copper plating bath) was discussed by Donbrow [2]. Possible degradation processes of brightener and carrier for copper plating baths were suggested by Dietz [3]. He concluded that the dosing logic for carrier based on the charge that flown through the plating solution cannot be correlated with carrier depletion. Dietz listed several contaminants that interfere with the brightener function: foreign metal contaminants, wetting agents from upstream cleaning operations, pre-plate microetchants, and materials leaching out of photoresists. Another possible foreign contamination are remains of hydrogen peroxide used for plating tank leaching and/or carbon treatment cycles.

None of the current techniques for plating bath components analysis, reviewed by Wikiel et al. [1], deal with bath contamination at all, assuming performance of plating bath being equal to the freshly prepared plating solution.

The only existing method of checking the plating bath performance based on the visual examination of the deposit is Hull cell test that cannot be performed with in-tank electrochemical sensors. Two different sets of equipment must therefore be maintained in order to perform constituent analysis and contamination detection, as those two factors determine proper performance of the plating bath. No integrated measurement system is available which is capable of measuring constituent concentrations and of detecting bath contamination. Additionally, the major drawback of the Hull cell test is its capability to detect bath contamination only after the plating performance is already impeded. There is no existing technique for early detection of plating bath contamination that would enable execution of proper counter measurements before the plating performance is affected by the presence of contaminants.

Early detection of bath malfunctioning is crucial to avoid losses especially in the electronic industry where the cost of silicon wafers plated with defects may be sometimes measured in hundreds of thousands dollars. Recently implemented to the semiconductor manufacturing copper damascene plating process is especially sensitive to any unexpected perturbation. This includes not only any deviation from a very tight process specification, but also an extremely difficult to control accumulation of organic additive breakdown products. A complex structure on wafer surface (consisting of sub-micrometer size features—vias and trenches) has to be filled-in with copper with no defects, during the deposition step. The ability of the copper plating bath to fill-in this kind of small feature depends very much on the ratio of the organic additives—suppressors and accelerators. The mechanism of curvature enhanced accelerator coverage was proposed to explained superfilling properties of the electrolyte [4-7]. A pronounced hysteresis is observed in the copper voltammogram taken for the solution with such superfilling properties. But it is well known that the breakdown products of the accelerator can display either acceleration and/or suppression effect, while breakdown products of suppressors will be showing suppression effects of various strength. Thus the performance of a plating bath can be impeded severely because of such additional, and not controlled by any means, effects. Plating problems can be observed in solution with accumulated breakdown products, even when the deliberately added components of plating bath, measured by any analytical method, are within the specification range. Thus, even the accurate analysis of all of the target components may be not enough for the good performance of a plating bath.

The harmful effect of accumulated degradation products will be very dependent on the process specification and the size of features to be plated. Certain level of breakdown products can be fully acceptable for plating 0.25-micron features, while the same amount can produce defective parts when plating 0.13-micron or smaller gaps. In order to keep good bath performance, a renovation process called bleed-and-feed was introduced into the plating practice for semiconductor manufacturing. Every certain amount of time, a portion of the plating solution is removed from the tank and replaced with a freshly-prepared, contamination-free plating bath. This process is done without any analytical control. Thus, very often this procedure is performed unnecessarily, causing a total waste of still good (and also expensive) plating solution.

There is no simple and straightforward analytical method to evaluate the effect of degradation products of organic additives. So it is apparent that there presently is a need for a fast and inexpensive method capable of monitoring bath performance and/or early detection of plating problems.

SUMMARY OF THE INVENTION

Disclosed is a process to produce a predictive data set which can be used to predict the property of a plating solution, said process comprising:

(a) obtaining a sample set, wherein each sample comprises a plating solution of good performance;

(b) obtaining an electroanalytical response for each said sample to produce a electroanalytical response data set;

(c) obtaining a training set that comprises said sample set and corresponding said electroanalytical response data set;

(d) analyzing said training set using decomposition method coupled with discriminant analysis method to produce a discriminant parameters data set; and (e) validating said training data set to produce said predictive data set for a predictive model.

In a preferred embodiment, the present invention is directed to a process to predict the property of a plating solution, said process comprising:

(a) producing a predictive data set, the predictive data set generated by:

(a1) obtaining a sample set, wherein each sample comprises an electrolyte solution of good performance;

(a2) obtaining an electroanalytical response for each said sample to produce an electroanalytical response data set;

(a3) obtaining a training set that comprises said sample set and corresponding said electroanalytical response data set;

(a4) preprocessing of said electroanalytical response data set;

(a5) analyzing said training set using decomposition method coupled with discriminant analysis method to produce a discriminant parameters data set;

(a6) validating said training data set to produce said predictive data set for a predictive model; and (b) using said predictive data set to predict the property of said plating solution, said property predicted by:

(b1) obtaining an unknown sample set, wherein each unknown sample in said unknown sample set contains a plating solution;

(b2) obtaining an electroanalytical response for each said unknown sample to produce an electroanalytical response data set;

(b3) preprocessing of said electroanalytical response data set; and (b4) applying said predictive model to predict property of each said unknown sample.

In another a preferred embodiment, the present invention is directed to a process to detect faulty performance of a plating solution, said process comprising:

(a) producing a predictive data set, the predictive data set generated by:

(a1) obtaining a sample set, wherein each sample comprises an electrolyte solution of good performance;

(a2) obtaining an electroanalytical response for each said sample to produce an electroanalytical response data set;

(a3) obtaining a training set that comprises said sample set and corresponding said electroanalytical response data set;

(a4) preprocessing of said electroanalytical response data set;

(a5) analyzing said training set using decomposition method coupled with discriminant analysis method to produce a discriminant parameters data set;

(a6) validating said training data set to produce said predictive data set for a predictive model; and (a7) specifying the limits of good and faulty performance of said plating solution; and (b) using said predictive data set to predict the property of said plating solution and qualify said solution as correct or faulty said process comprises:

(b1) obtaining an unknown sample set, wherein each unknown sample in said unknown sample set contains a plating solution;

(b2) obtaining an electroanalytical response for each said unknown sample to produce an electroanalytical response data set;

(b3) preprocessing of said electroanalytical response data set;

(b4) applying said predictive model to predict property of each said unknown sample; and (b5) qualifying said unknown samples as correct or faulty.

In another preferred embodiment, the present invention is directed to a method of monitoring performance of a plating solution in order to perform controlled feed and bleed procedure, said process comprising the steps of:

(a) producing a predictive data set, the predictive data set generated by:

(a1) obtaining a sample set, wherein each sample comprises an electrolyte solution of good performance;

(a2) obtaining an electroanalytical response for each said sample to produce an electroanalytical response data set;

(a3) obtaining a training set that comprises said sample set and corresponding said electroanalytical response data set;

(a4) preprocessing of said electroanalytical response data set;

(a5) analyzing said training set using decomposition method coupled with discriminant analysis method to produce a discriminant parameters data set;

(a6) validating said training data set to produce said predictive data set for a predictive model;

(a7) defining the limits of said property for said plating solution that requires feed and bleed procedure; and (b) using said predictive data set to predict the property of said plating solution and qualify said solution as correct or faulty said process comprises:

(b1) obtaining an unknown sample set, wherein each unknown sample in said unknown sample set contains a plating solution;

(b2) obtaining an electroanalytical response for each said unknown sample to produce an electroanalytical response data set;

(b3) preprocessing of said electroanalytical response data set;

(b4) applying said predictive model to predict property of each said unknown sample; and (b5) qualifying said unknown samples as a ready or not ready solution for feed and bleed procedure.

In another preferred embodiment, the present invention is directed to a method of monitoring the performance of an electroplating solution in order to perform controlled purification treatment procedure, said process comprising the steps of:

(a) producing a predictive data set, the predictive data set generated by:

(a1) obtaining a sample set, wherein each sample comprises an electrolyte solution of good performance;

(a2) obtaining an electroanalytical response for each said sample to produce an electroanalytical response data set;

(a3) obtaining a training set that comprises said sample set and corresponding said electroanalytical response data set;

(a4) preprocessing of said electroanalytical response data set;

(a5) analyzing said training set using decomposition method coupled with discriminant analysis method to produce a discriminant parameters data set;

(a6) validating said training data set to produce said predictive data set for a predictive model; and (a7) defining the limits of said property for said plating solution that requires purification treatment; and (b) using said predictive data set to predict the property of said plating solution and qualify said solution as correct or faulty said process comprises:

(b1) obtaining an unknown sample set, wherein each unknown sample in said unknown sample set contains a plating solution;

(b2) obtaining an electroanalytical response for each said unknown sample to produce an electroanalytical response data set;

(b3) preprocessing of said electroanalytical response data set;

(b4) applying said predictive model to predict property of each said unknown sample; and (b5) qualifying said unknown samples as ready or not ready for purification treatment.

In another preferred embodiment, the present invention is directed to a method of monitoring of the performance of a measuring system in order to detect its malfunctioning, said process comprising the steps of:

(a) producing a predictive data set, the predictive data set generated by:

(a1) obtaining a training set, wherein each sample comprises an electronic characteristic of a measurement system of good performance;

(a2) preprocessing of said training data set;

(a3) analyzing said training set using decomposition method coupled with discriminant analysis method to produce a discriminant parameters data set;

(a4) validating said training data set to produce said predictive data set for a predictive model; and (a5) defining the limits of said property for said electronic characteristic of the well performed measurement system; and (b) using said predictive data set to predict the malfunctioning of measurement system said process comprises:

(b1) obtaining a second data set, wherein each sample comprises an a periodically taken electronic characteristic of a measurement system;

(b2) preprocessing of said second data set;

(b3) applying said predictive model to predict property of each sample of a second data set; and (b4) detecting malfunctioning of measurement system by qualifying said property as a fault.

BRIEF DESCRIPTION OF DRAWINGS

FIG. 1 shows an example of Hull cell panels (2A, % min.) obtained from the pure PC 75 copper plating bath (A) and after addition of 2 ml/l of TEG.

FIG. 2 shows an example of Plot of first principal components versus second principal components. Training set solutions: diamonds; bath samples contaminated with TEG: circles (numbers—concentration of TEG in ml/l). Scan dq21cr2, channel 3, 300–1200, calculated based on 4-factor decomposition.

FIG. 3 shows an example of Plot of first principal components versus Q residuals. Training set solutions: diamonds; bath samples contaminated with TEG: circles (numbers—concentration of TEG in ml/l). Scan dq21cr2, channel 3, 300–1200, 4 factors.

FIG. 4 shows an example of Plot of all outlier qualifiers versus temperature for the PC 75 copper bath.

FIG. 5 shows an example of Plot of all outlier qualifiers versus copper concentration for PC 75 copper bath.

FIG. 6 shows an example of Plot of all outlier qualifiers versus brightener concentration for PC 75 copper bath.

FIG. 7 shows an example of Voltammograms for solutions from industrial training set and an industrial sample contaminated with $H_2O_2$.

FIG. 8 shows an example of Voltammograms for PC 75 copper bath showing a hysteresis in copper reduction for various concentration of brightener.

FIG. 9 shows an example of Plot of all outlier qualifiers for hysteresis in PC75 bath versus concentration of brightener in solution.

FIG. 10 shows an example of Voltammograms for solutions from training set and a solution that was replenished improperly.

FIG. 11 shows an example of Plot of MD values for copper reduction in industrial solution with passive consumption (A—no plating, circulation only), and industrial solution with active consumption and with feed and bleed (B—plating).

FIG. 12 shows an example of Voltage time plot for a typical (100) and faulty (200) electronic conditions of the measuring system.

DETAILED DESCRIPTION OF THE INVENTION

Unless otherwise stated, computations were done using the Matlab Ver. 6.0 environment (The Math Works, Inc., Natick, Mass.) with the PLS_Toolbox Ver. 2.1.1 (Eigenvector Research, Inc., Manson, Wash.).

Data Description

The data of the training set consists of independent variables, voltammograms, and dependent variables, concentrations corresponding to the voltammograms. The number of independent variables, which corresponds to the chosen number of points of the voltammogram taken for the analysis, equals n. The number of dependent variables, in the cases discussed below, equals unity. The number of samples in the training set is m.

The original data consists of a matrix of independent variables, $X^O(m,n)$, and a vector of dependent variables, $c^O(m)$. The upper index "O" denotes original (means not transformed). According to the formalism employed throughout the text a bold capital letter denotes a matrix. Some matrices are described by two bold letters, the first of which is capital. A bold small case letter(s) denotes a vector. The superscript "T" and the subscript "−1" denote a transposed matrix/vector and an inverse matrix, respectively. The subscript "u" denotes an unknown sample(s).

Data Preprocessing

Preprocessing refers to the transformation of the original data in order to enhance the information representation. After the transformation a variable is referred to as a feature to distinguish it from the original variable.

The preprocessing method most commonly applied throughout this paper is the autoscaling to unit variance [8,9] which refers to meancentering followed by dividing by the standard deviation, $s_j$, on a variable by variable basis:

$$x_{i,j} = \frac{x_{i,j}^{O} - x_j^{\mu}}{s_j} \quad (1)$$

where $$x_j^{\mu} = \frac{\sum_{i=1}^{m} x_{i,j}^{O}}{m} \quad (2)$$

and $$s_j = \sqrt{\frac{1}{m-1}\sum_{i=1}^{m}(x_{i,j}^{O} - x_j^{\mu})^2} \quad (3)$$

Application of autoscaling transforms original variables $X^O$ and $c^O$ into features X and c, respectively.

If not otherwise stated, all features, both dependent (c) and independent (X), of the calculations presented below are assumed to be autoscaled to unit variance. Independent variables for prediction are being transformed prior the calculations using autoscaling parameters of the training set. Predicted concentrations (dependent variables) are obtained via retransformation of predicted independent features using autoscaling parameters of the training set.

Calibration Calculation

The properly conducted calibration starts with several preparatory steps that were discussed in details by Wikiel et al. [1]. The first step is the determination of the optimal calibration range. The following step aimed at outlier detection within the training set prior regression calculation requires a closer look as it is also used for generation of some statistical parameters applied for outlier detection among unknown samples. The Principal Component Analysis (PCA) [10,11] method is applied to decompose matrix X(m,n) into matrices being outer products of vectors called scores (S(m,a)) and loadings (V(n,a)), where a is a number of factors capturing most of the total variance. Several methods, pair-by-pair nonlinear iterative partial least squares (NIPALS) [9,12], successive average orthogonalization (SAO) [13] and that calculating all the principal components at once via the variance co-variance matrix (Jacobi transformation [14,15], Householder reduction [14,15]) were used to decompose data matrix X. The results of all methods were practically identical. The PCA calculations were done in MS Visual Basic (VB) and were compared to results obtained with Matlab Singular Value Decomposition technique to reach full agreement. All computations discussed below connected with outlier detection were done in VB and in Matlab mostly in order to verify their correctness. In case of VB programs the NIPALS method was chosen as optimal (based mostly on the time factor) for X matrix decomposition.

The regression is calculated using PCR [16–18] and PLS [8, 9, 16–19] method. Both of the regression methods are described in detail in the literature and are commonly used.

As stressed by Wikiel et al. [1], it is highly recommended to perform calculations aiming at obtaining the optimal number of factors (by PRESS [8]) and eliminating outliers by regression calculation from the training set (methods based on concentration residuals: F-ratio and Studentized concentration residuals versus leverages plot [1,20]) in the iterative sequence. The iteration should stop when the optimal number of factors is calculated and there are no outliers in the training set.

Having the correct number of factors determined and the outlier-free training set, one can perform the final regression calculation using PLS or PCR methods. The outlier-free training set is also used for calculation of parameters like Mahalanobis matrix (Equation 9), Mahalanobis matrix calculated based on the residual augmented scores (Equation 11), residual variance (Equation 14) or residual sum of squares (Equation 6) which are later employed for outlier detection for unknown samples (Equation 17). The methods listed-above consist the core of the text presented below.

EXAMPLE 1

Concentration Prediction Calculation for Unknown Samples

Obtained regression equations are used for prediction of carrier and brightener concentrations in samples of copper plating bath (PC 75, Technic, Inc.) contaminated with different concentration of tetra(ethylene glycol). Predicted concentrations of these two components are presented in Table 1. Actual concentrations of both analyzed components were 5.0 mL/L, what corresponds to the nominal values for analyzed bath. Concentration predictions for both carrier and brightener seem not to be noticeably affected by the presence of contaminant, even for the highest values of contaminant concentration. Analyzing these predictions, only the plating bath operator would be unaware of worsening conditions of the bath due to contamination leading to bad plating performance.

TABLE 1

Concentration prediction using PCR and PLS-1 methods. PC 75 copper plating bath (Technic, Inc.).

| | TEG Conc. (ppm) | CARRIER Conc. = 5.0 ml/l | BRIGHTENER Conc. = 5.0 ml/l |
|---|---|---|---|
| | | PCR | PCR |
| 1 | 0 | 4.67 | 5.59 |
| 2 | 1 | 4.63 | 5.47 |
| 3 | 5 | 4.5 | 5.31 |
| 4 | 25 | 4.54 | 4.86 |
| 5 | 50 | 4.59 | 5.12 |
| 6 | 100 | 4.77 | 4.8 |
| 7 | 200 | 5 | 4.71 |
| 8 | 25 | 4.77 | 5.42 |
| 9 | 25 | 4.75 | 5.42 |
| 10 | 25 | 4.79 | 5.19 |
| 11 | 200 | 5.17 | 5.54 |
| 12 | 200 | 5.19 | 5.57 |
| 13 | 200 | 5.19 | 5.45 |
| | Average | 4.67 | 5.27 |
| | RelativeSD | 5.25% | 5.79 |
| | | PLS-1 | PLS-1 |
| 1 | 0 | 4.69 | 5.60 |
| 2 | 1 | 4.65 | 5.48 |
| 3 | 5 | 4.52 | 5.31 |
| 4 | 25 | 4.56 | 4.87 |
| 5 | 50 | 4.61 | 5.13 |
| 6 | 100 | 4.80 | 4.81 |
| 7 | 200 | 5.03 | 4.71 |
| 8 | 25 | 4.79 | 5.43 |
| 9 | 25 | 4.77 | 5.42 |
| 10 | 25 | 4.81 | 5.20 |
| 11 | 200 | 5.21 | 5.54 |
| 12 | 200 | 5.22 | 5.57 |
| 13 | 200 | 5.23 | 5.46 |
| | Average | 4.84 | 5.27 |
| | RelativeSD | 5.25 | 5.77 |

One should realize that knowledge of the concentrations of components of the plating bath, which can be obtained via calibration and subsequent prediction, may not be sufficient information necessary to control the performance of that bath. The bath contaminants of various origin (mostly organic additives degradation products) accumulating in time may significantly impede the bath plating performance. Such a situation can take place even if concentrations of deliberately added bath components are within the specification limits.

EXAMPLE 2

Hull Cell Experiment

PC 75 carrier, which is a polyglycol ether, undergoes degradation in the plating bath yielding shorter chain polyglycol fractions [21]. The degradation is difficult to monitor indirectly because is not correlated with amount of electricity flowing through the plating bath. A series of experiments were conducted employing PC 75 plating solution containing nominal concentration of brightener and carrier. The freshly prepared solution produces a uniform, bright deposit. Small additions of tetraethylene glycol (TEG, 4-monomer fragment of polyethylene glycol) up to 200 ppm produce Hull cell panels of acceptable to marginally acceptable appearance. An addition of TEG at a level higher than 200 ppm leads to a dull deposit with vertical streaks (1B).

Below there are presented several approaches applying PCA and various versions of Mahalanobis distance, SIMCA, $F^s$-ratio methods in order to determine the presence of the contaminant.

Outlier Detection Among Unknown Samples

While looking for a reliable calibration range and channel of the experimental voltammograms one is focused on current responses changing only with the concentration of the calibrated component. This means that the current signal should not be affected by the presence of all other bath components including degradation products and foreign contaminants. This approach was described by Wikiel et al. [1] in the chapter "Determination of the calibration range". A completely opposite approach should be applied while picking up ranges and channels whose shape is possibly strongly affected by the presence of contaminants and/or foreign contaminants.

The presence of contaminants may change the shape of the voltammogram making it qualitatively and quantitatively different then the voltammograms of the training set. Therefore, by applying various chemometric methods one can quantify and detect outlying voltammograms that are affected by contaminants and/or foreign contaminants.

In the experiments whose results are presented below, the freshly prepared nominal solutions of the plating bath were deliberately contaminated with tetra(ethylene glycol) of various concentration. This component is a possible degradation product of one of organic additives and can accumulate in the plating bath tank over time.

The first method one can apply for outlier detection is a graphic approach based on the PCA method. In this method the scores for two first principal components are plotted against each other. The scores for PC1 versus PC2 plot are calculated in the following way:

- The scores for training set are calculated by the PCA decomposition of autoscaled training set matrix, X(m, n), to scores, S(m,a), and eigenvectors, V(n,a), for a number of factors a=2.
- The row vector of original unknown sample, $x_u^O$, is scaled using parameters of the training set to obtain $x_u$.
- The scores for unknown sample (the one suspected to be an outlier) are calculated by multiplication of matrix of unknown voltammograms by eigenvector matrix of training set:

$$s_{u=xu}V, \tag{4}$$

where subscript u denotes unknown sample.

EXAMPLE 3

A typical PC2 versus PC1 plot is presented in FIG. 2. One can notice that the scores of the training set are clustered. For the contaminated samples, the distance from the training set cluster increases with the increase in contaminant concentration, starting from 5 ppm. One can notice that the sample containing 1 ppm of contaminant, due to its location within the training set cluster, would not be detected as an outlier on this voltammogram yet. However, the sample containing 5 ppm of contaminant is already outside the training set cluster.

Another approach is based on projection of residual sum of squares for both training set and unknown samples versus principal component. The residuals for the training set are calculated quite straightforwardly:

- The autoscaled training set matrix, X, is decomposed by PCA to scores (S) and eigenvectors (V) for a number of factors of a.
- The training set matrix is reconstructed using calculated scores and eigenvectors:

$$\hat{X}=SV^T \tag{5}$$

- For each i-th sample from the training set the residual sum of squares, also called Q-residuals, is calculated employing the following formula:

$$rs_i = \sum_{j=1}^{n} (x_{i,j} - x_{i,j})^2 \tag{6}$$

Calculation of the residuals for unknown samples is a little more complex. For each unknown sample the following procedure should be applied:

- The autoscaled training set matrix, X, is being decomposed to scores (S) and eigenvectors (V) for a certain number of factors of a.
- Unknown sample vector, $x_u^O(n)$, is being scaled using parameters from the training set to obtain $x_u(n)$.
- The vector of residuals for unknown sample is calculated using equation:

$$e_u=x_u(I-VV^T) \tag{7}$$

where I(n,n) is an identity matrix. The identity matrix is always square and contains ones on the diagonal and zeros everywhere else.

- The residual sum of squares (Q residuals) for the unknown sample is calculated from the following expression:

$$rp_u = \sum_{j=1}^{n} e_{u,j}^2 \tag{8}$$

EXAMPLE 4

The projection of the residual sum of squares for both training set and unknown samples versus first principal component is shown in FIG. 3. One can notice much bigger quantitative selectivity of Q residuals versus PC1 projection than that of PC2 versus PC1. The vertical width of the training set cluster is much smaller relative to the vertical distance of the outliers from the training set cluster in FIG. 3 than in FIG. 2.

Outliers can also be predicted quantitatively (purely numerically not graphically) using several of versions of Mahalanobis Distance method coupled with PCA: regular MD/PCA (also called MD) and Mahalanobis Distance by Principal Component Analysis with residuals (MD/PCA/R; also called MDR). The procedure for prediction of squared Mahalanobis Distance value in unknown samples in MD/PCA is presented below:

Autoscaled matrix X(m,n) is decomposed by PCA to principal components (scores), S, and loadings (eigenvectors), V.

The Mahalanobis matrix is calculated for the training set via the following equation:

$$M=S^TS/(m-1) \tag{9}$$

Unknown sample vector, $x_u^O(n)$, is being scaled using parameters from the training set to obtain $x_u(n)$.

Scores for the unknown sample are computed employing Equation 4.

The squared Mahalanobis distance for unknown sample is calculated using the following equation:

$$D_u^{2=s}{}_uM^{-1}s_u^T \tag{10}$$

Values of Mahalanobis distance for unknown samples are compared with that for the training set.

EXAMPLE 5

In Table 2 are listed $D_u$ values obtained from data of different voltammograms for various concentration of the contaminant. For comparison, the largest acceptable values of D for corresponding training sets are presented. One can notice that the sensitivity of MD/PCA method depends strongly on the kind of analyzed voltammogram (its waveform). Some voltammograms (mc1, ch2; s4, ch6; cr2, ch3) are particularly sensitive to presence of contaminant, and $D_u$ value increases with increasing concentration of the contaminant. However, there are also voltammograms that seem not to be affected by the presence of contaminant (cuac ch5).

It is noticeable that the sensitivity of outlier detection by Mahalanobis Distance can be much higher than a simple functional test of Hull cell panel plating. In Example 2, for up to 200 ppm of TEG there was no obvious effect of this compound on the Hull cell panel plating performance. In table 2, one can easily notice that the significant electrochemical effect (expressed as Mahalanobis Distance) can be detected at the presence of TEG as low as 5 ppm.

TABLE 2

| | | Mahalanobis Distance prediction | | | |
|---|---|---|---|---|---|
| Soln # | TEG concentration ppm | S4; channel6, 200–250 | Mcl; channel2 180–280 | Cuac; channel5 120–260 | Cr2; channel3 300–1200 |
| 1 | 0 | 1.12 | 1.13 | 1.54 | 1.93 |
| 2 | 1 | 1.68 | 2.26 | 1.64 | 2.47 |
| 3 | 5 | 5.64 | 6.84 | 1.89 | 5.37 |
| 4 | 25 | 19.51 | 26.22 | 2.62 | 12.10 |
| 5 | 50 | 30.60 | 44.10 | 3.16 | 16.95 |

TABLE 2-continued

| | | Mahalanobis Distance prediction | | | |
|---|---|---|---|---|---|
| Soln # | TEG concentration ppm | S4; channel6, 200–250 | Mcl; channel2 180–280 | Cuac; channel5 120–260 | Cr2; channel3 300–1200 |
| 6 | 100 | 46.54 | 67.33 | 3.44 | 18.93 |
| 7 | 200 | 66.09 | 103.63 | 3.52 | 22.80 |
| 8 | 25 | 19.49 | 27.67 | 2.34 | 12.59 |
| 9 | 25 | 19.89 | 25.87 | 2.51 | 12.97 |
| 10 | 25 | 19.83 | 27.20 | 1.68 | 12.89 |
| 11 | 200 | 67.62 | 104.26 | 3.38 | 22.18 |
| 12 | 200 | 68.17 | 103.63 | 3.01 | 22.23 |
| 13 | 200 | 68.13 | 105.88 | 3.31 | 21.06 |
| Max. MD from cross-validation within training set | | 3.29 | 3.87 | 4.26 | 3.26 |

The procedure for MD/PCA/R [22] is more complex than that for MD/PCA:

Autoscaled matrix X(m,n) is decomposed by PCA to principal components (scores), S, and loadings (eigenvectors), V.

The training set matrix is reconstructed using calculated scores and eigenvectors via Equation 5.

For each i-th sample from the training set the residual sum of squares is calculated employing the Equation 6. The result is a column vector rs(m).

The column vector rs is appended as the a+1$^{st}$ column to the matrix of scores S(m,a). This creates a residual augmented scores matrix, T(m,a+1). The i-th row of matrix T is the vector $t_i$.

The calculation of the Mahalanobis matrix is done on the matrix T:

$$Mr=T^TT/(m-1) \tag{11}$$

Unknown sample vector, $x_u^O(n)$, is scaled using parameters from the training set to obtain $x_u(n)$.

Scores for unknown sample, row vector $s_u(a)$, are calculated using Equation 4.

The column vector of residuals for the unknown sample, $e_u$, is calculated employing Equation 7.

Squared sum residuals of the unknown sample, $rp_u$, is computed according to the Equation 8.

The scalar $rp_u$ is appended as the a+1$^{st}$ value in the row vector $s_u(a)$. This creates a residual augmented scores vector, $t_u(a+1)$.

The square Mahalanobis Distance is predicted for the unknown sample applying the following expression:

$$Dr_u^{2=t}{}_uMr^{-1}t_u^T \tag{12}$$

EXAMPLE 6

In Table 3 there are listed $Dr_u$ values obtained from same data used to calculate $D_u$ in Table 2. Qualitatively the performance of MD/PCA/R is similar to that of MD/PCA in cases of mc1, ch2 (180–280), cr2 ch3 (300–1200), and s4 ch6 (200–250). The voltammogram cuac-ch5 remains insensitive to contaminant concentration throughout whole range of TEG concentrations while analyzed with MD/PCA (Table 2, column 5). In contrast, MD/PCA/R detects outliers from the level of TEG concentration of 5 ppm while analyzing the same data set (Table 3, column 5). Comparing the performance of MD/PCA and MD/PCA/R presented in Tables 2 and 3, one can conclude that the latter method has much higher resolution that the former one.

TABLE 3

| Mahalanobis Distance with residuals prediction | | | | | |
|---|---|---|---|---|---|
| Soln # | TEG concentration ppm | S4; channel6, 200–250 | Mcl; channel2 180–280 | Cuac; channel5 120–260 | Cr2; channel3 300–1200 |
| 1 | 0 | 1.33 | 1.89 | 1.87 | 2.13 |
| 2 | 1 | 2.51 | 3.29 | 2.02 | 2.77 |
| 3 | 5 | 15.55 | 21.34 | 2.40 | 10.13 |
| 4 | 25 | 87.94 | 246.21 | 4.64 | 43.53 |
| 5 | 50 | 163.84 | 662.10 | 7.33 | 66.64 |
| 6 | 100 | 324.93 | 1514.00 | 8.67 | 100.29 |
| 7 | 200 | 631.18 | 3451.35 | 10.41 | 137.65 |
| 8 | 25 | 91.85 | 270.57 | 4.54 | 43.57 |
| 9 | 25 | 95.32 | 244.51 | 4.61 | 43.90 |
| 10 | 25 | 92.45 | 263.22 | 3.38 | 43.44 |
| 11 | 200 | 674.79 | 3573.39 | 10.61 | 143.68 |
| 12 | 200 | 680.93 | 3545.99 | 9.83 | 142.16 |
| 13 | 200 | 680.78 | 3658.35 | 10.90 | 159.31 |
| Max. MD with residuals from cross validation within training set | | 5.52 | 4.1 | 6.7 | 4.24 |

The SIMCA (SImple Modeling of Class Analogy) [8] method can also be applied for checking whether the unknown sample is a typical category member or is very distant from the model (training set) and therefore should be considered an outlier to that model. The procedure for outlier detection by SIMCA is following:

Autoscaled matrix X(m,n) is decomposed by PCA to principal components (scores), S, and loadings (eigenvectors), V.

The matrix of residuals for the training set is calculated from the following expression:

$$E=X-SV^T \tag{13}$$

The residual variance for training set X is calculated using the following equation:

$$rv_0^2=\sum_{i=1}^{m}\sum_{j=1}^{n}\frac{e_{i,j}^2}{(m-a-1)(n-a)} \tag{14}$$

where e is an element of the matrix E.

The vector of unknown sample, $x_u(n)$, is being scaled using parameters from the training set.

The vector of residuals for unknown sample, $e_u(n)$, is calculated using Equation 7.

The predicted residual variance for $x_u$ normalized with respect to $rv_0^2$ is computed employing the following expression:

$$rv_u^2=\sum_{j=1}^{n}\frac{e_{u,j}^2}{(n-a)rv_0^2} \tag{15}$$

In the following text, the results of predicted residuals variance normalized with respect to residual variance in the training set will be referred as SIMCA.

EXAMPLE 7

The procedure described above was used for outlier detection (Table 4) for the same data files as that of Table 3. Comparing Table 3 to Table 4, one can easily notice that SIMCA performs very similarly both qualitatively and quantitatively to MD/PCA/R. Therefore these two techniques can be applied equivalently for outlier detection for AC/DC voltammograms.

TABLE 4

| Predicted residual variance normalized with respect to residual variance in the training set. | | | | | |
|---|---|---|---|---|---|
| Soln # | TEG concentration Ppm | S4; channel6, 200–250 | Mcl; channel2 180–280 | Cuac; channel5 120–260 | Cr2; channel3 300–1200 |
| 1 | 0 | 0.83 | 1.53 | 0.73 | 1.08 |
| 2 | 1 | 2.36 | 2.17 | 0.84 | 1.17 |
| 3 | 5 | 19.13 | 20.63 | 0.98 | 8.11 |
| 4 | 25 | 115.03 | 263.95 | 3.44 | 40.09 |
| 5 | 50 | 216.53 | 719.12 | 6.49 | 61.86 |
| 6 | 100 | 433.03 | 1655.15 | 7.95 | 94.91 |
| 7 | 200 | 845.18 | 3788.06 | 10.10 | 130.87 |
| 8 | 25 | 120.36 | 290.50 | 3.48 | 39.96 |
| 9 | 25 | 125.01 | 262.20 | 3.38 | 40.17 |
| 10 | 25 | 121.11 | 282.51 | 2.62 | 39.74 |
| 11 | 200 | 903.80 | 3922.78 | 10.36 | 136.99 |
| 12 | 200 | 912.06 | 3892.64 | 9.67 | 135.48 |
| 13 | 200 | 911.84 | 4016.34 | 10.77 | 152.69 |
| Max. values from cross validation within training set | | 7.44 | 3.43 | 7.57 | 3.20 |

Another approach for detecting the outliers due to contamination in unknown samples is the F-ratio method based on residuals calculated for independent features, $F^s$ ratio. First, the $F^s$-ratios are computed for the training set in order to determine the maximal acceptable value of $F^s$-ratio [19] for the prediction:

$$F_i^s=\frac{(m-1)rs_i}{\sum_{j\neq i} rs_j} \tag{16}$$

where $rs_i$ is described by Equation 6.

Then the $F^s$-ratios for unknown sample are calculated using the following equation [19]:

$$F_u^s=\frac{(m)rp_u}{\sum_{j=1}^{m} rs_j} \tag{17}$$

where $rp_u$ is defined in Equation 8.

EXAMPLE 8

The results of calculation of $F^s$-ratios for some voltammograms are presented in Table 5. Results in Table 5 are analogous both qualitatively and quantitatively to those in Tables 3 and 4. It suggests that in considered cases Mahalanobis Distance values in case of MD/PCA/R method are determined in greater degree by residuals than by scores.

TABLE 5

$F^S$-ratio for residuals of voltammograms of unknown samples.

| Soln # | TEG concentration ppm | S4; channel6, 200–250 | Mcl; channel2 180–280 | Cuac; channel5 120–260 | Cr2; channel3 300–1200 |
|---|---|---|---|---|---|
| 1 | 0 | 0.92 | 1.69 | 0.80 | 1.19 |
| 2 | 1 | 2.62 | 2.41 | 0.93 | 1.30 |
| 3 | 5 | 21.25 | 22.87 | 1.09 | 8.99 |
| 4 | 25 | 127.81 | 292.64 | 3.81 | 44.45 |
| 5 | 50 | 240.59 | 797.28 | 7.20 | 68.58 |
| 6 | 100 | 481.14 | 1835.06 | 8.81 | 105.22 |
| 7 | 200 | 939.09 | 4199.80 | 11.20 | 145.09 |
| 8 | 25 | 133.73 | 322.08 | 3.86 | 44.30 |
| 9 | 25 | 138.91 | 290.71 | 3.75 | 44.54 |
| 10 | 25 | 134.56 | 313.22 | 2.90 | 44.06 |
| 11 | 200 | 1004.22 | 4349.17 | 11.48 | 151.89 |
| 12 | 200 | 1013.40 | 4315.75 | 10.72 | 150.21 |
| 13 | 200 | 1013.16 | 4452.90 | 11.94 | 169.28 |
| Max. $F^S$ ratio values for self-prediction within training set | | 5.13 | 3.14 | 6.91 | 3.23 |

The above examples (1–8) were focused on a copper plating bath with deliberately added TEG, which simulates a possible breakdown product of organic additives. Some studies were conducted in order to determine the fault detection ability of several chemometric outlier detection techniques to detect problems caused by other factors. The training set consisted of 25 solutions of a Copper PC75 bath (Technic, Inc.) prepared according to 5-component, 5-level linear orthogonal array. The concentration ranges for copper, acid, chloride, carrier and brightener were 14–20 g/L, 140–200 g/L, 30–80 ppm, 3.0–8.0 mL/L and 3.0–8.0 mL/L, respectively. Additionally, the training set contained 9 solutions having copper, acid and chloride on the nominal level of 17.5 g/L, 175 g/L and 55 ppm, respectively. The concentrations of carrier and brightener were varied within the calibration ranges according to 2-component, 3-level full factorial array. The last solution of the training set contained all the five components on their nominal level, which for carrier and brightener is 6 mL/L and 5 mL/L, respectively. Each solution of the training set was analyzed in duplicate.

The outlying scans were generated using nominal solution with one experimental parameter being varied out of calibration conditions at a time.

EXAMPLE 9

The nominal temperature for copper PC75 bath is 25° C. In order to generate the outliers due to temperature, the voltammetric data was collected for the PC75 bath solution of nominal composition at various temperatures: 6, 15, 30, 40 and 50° C. Four afore-mentioned outlier detection techniques were applied for shape analysis of the voltammogram (dq 21cu, channel 2, 200–1000, 3 factors). This voltammogram was chosen because its shape is sensitive to changes in the bath induced by various factors. The obtained results are presented in FIG. 4. The maximal acceptable value of the outlier detection parameters obtained by crossvalidation within the training set were 3.39, 4.26, 3.72 and 3.95 for MD/PCA, MD/PCA/R, SIMCA and $F^S$ ratio, respectively. One can notice much larger sensitivity for the methods utilizing Q residuals in comparison to MD/PCA. The scale of the response for MD/PCA/R, SIMCA and $F^S$ ratio is one order of magnitude larger than that of MD/PCA while maximal acceptable values for all three techniques are very close to each other. In contrary to sensitive MD/PCA/R, SIMCA and $F^S$ ratio, the MD/PCA was not able to detect outliers at 30° C. and barely detected outliers at 15° C.

EXAMPLE 10

In order to generate the outliers due to the copper concentration being out-of-calibration-range, the voltammetric data was collected for the PC75 bath solution with the copper content of 2, 5, 8, 12, 22 and 25 g/L. The concentrations of all other components and experimental conditions were nominal. The training data set is the same as in Example 9. The values of following chemometric parameters: MD/PCA, MD/PCA/R, SIMCA and $F^S$ ratio, are presented in FIG. 5. The shapes of voltammograms obtained for the copper concentration closest to the lower and upper calibration limit, namely 12 and 22 g/L, respectively, do not differ enough from that of the training set to be detected as outliers. As mentioned above, the shape of the dq21cu voltammogram within the range of 200–1000 changes with the concentrations of other than copper components too. At first glance this may seem disadvantageous, but on the other hand the dq21cu voltammogram can guard the plating bath from disturbances of various origins simultaneously.

EXAMPLE 11

In order to generate the outliers due to the brightener concentration being out-of-calibration-range, the voltammetric data was collected for the PC75 bath solution with the brightener content of 0, 0.5, 1.5, 10, 15 and 20 mL/L. The concentrations of all other components and experimental conditions were nominal. The training data set is the same as in Example 9. The values of following chemometric parameters: MD/PCA, MD/PCA/R, SIMCA and $F^S$ ratio, are presented in FIG. 6. One can easily notice much higher discriminative power of all Q residuals based techniques in comparison to MD/PCA. The MD/PCA/R, SIMCA and $F^S$-ratio methods proved to be capable to detect as outliers any solution containing brightener at the level different than that of the calibration range.

EXAMPLE 12

All of the examples discussed above deal with the outlier detection in the artificially (in controlled manner) prepared outlying samples. This example focuses on a real-life example of the industrial plating solution contaminated with hydrogen peroxide. This kind of contamination is quite common in the industrial electroplating where hydrogen peroxide is used to oxidize all organic components (mostly degradation products) accumulated in the used plating bath and/or for plating tank cleaning (leaching). Excess of hydrogen peroxide is supposed to decompose to water and oxygen, but some small amount of $H_2O_2$ may remain in the plating solution impeding its plating performance. The deformation of the voltammogram due to the presence of $H_2O_2$ contamination is apparent in FIG. 7 where voltammograms recorded for contaminated and training set solutions are compared. In this case the training set was composed of several tens of industrially recorded voltammograms. They consisted of a representative sample covering all concentration variations allowed by process control requirements. All four outlier detection chemometric techniques, MD/PCA, MD/PCA/R, SIMCA and $F^s$ ratio (range 15–25 s, 3 factors) easily detect voltammograms recorded for the contaminated bath as shown in the Table 6.

TABLE 6

Outlier detection for industrial solutions containing hydrogen peroxide as a foreign contaminant.

| Industrial sample | MD/PCA | MD/PCA/R | SIMCA | $F^s$ ratio |
|---|---|---|---|---|
| 11061419.2000 | 23.49 | 463.14 | 520.08 | 624.10 |
| 11061433.2000 | 22.93 | 426.33 | 478.57 | 574.29 |
| Max. value for crossvalidation within training set | 3.54 | 3.99 | 5.2 | 6.29 |

In this case the Q residual based techniques show greater sensitivity than MD/PCA.

EXAMPLE 13

Moffat et al. [4–7] correlated the formation of the hysteretic shape of the cyclic current vs. potential response obtained in a copper plating bath with the capability of superconformal electrodeposition. They proposed using the extent of this phenomenon to monitor and explore additive consumption and efficiency. FIG. 8 shows cyclic voltammograms obtained in PC75 copper plating bath with various concentration of PC75 brightener. The small hysteris loop can be observed in solutions with brightener concentration as low as 0.5 mL/L (10% of the nominal concentration). When the concentration of brightener increases, the size of this hysteretic loop is growing as well.

Hysteresis formation were observed (FIG. 8) for PC75 bath solutions when the brightener concentration was significantly below lower calibration limit (3 mL/L). All other concentrations were at their nominal level. The calculation of MD/PCA, MD/PCA/R, SIMCA and $F^s$ ratio was employed to check whether it is possible to quantify the hysteresis loop effect (size). The training set was the same as in Examples 9, 10 and 11. Results obtained from the calculations are presented in FIG. 9. For all outlier detection techniques the voltammograms recorded for brightener concentration 2.5 mL/L and lower are considered outlying. These results leave no doubt about the advantages of numerical versus visual approach for plating bath monitoring based on analysis of voltammetric data. One may notice that for this particular data there is no significant benefit in using Q residuals based methods in comparison to MD/PCA.

EXAMPLE 14

Human error can also be a cause of plating bath malfunctioning. Early detection of such malfunctioning can minimize production losses. In FIG. 10 there is shown a real-life industrial example of DC-voltammetric scan deformation caused by improperly replenished additives in the copper plating bath. The deformated voltammograms are compared to the proper ones belonging to the industrial training set. The prediction results obtained via calculation using MD/PCA, MD/PCA/R, SIMCA and $F^S$ ratio for deformated voltammograms for the temporal range of 20–45 s, using 3 factors are presented in Table 7. The sensitivity of the Q residual based techniques is much bigger than that of PCA/MD in this case. It is mainly due to large qualitative difference between outlying and training set voltammograms within the temporal range taken for calculations.

TABLE 7

Outlier detection for industrial solutions after operator's error.

| Industrial sample | MD/PCA | MD/PCA/R | SIMCA | $F^s$ ratio |
|---|---|---|---|---|
| 07201908.2000 | 37.20 | 13653.73 | 14949.01 | 16372.73 |
| 07202216.2000 | 36.90 | 13532.76 | 14816.57 | 16227.67 |
| Max. value for cross validation within training set | 3.86 | 4.96 | 4.36 | 4.78 |

EXAMPLE 15

Accumulation of degradation products in a plating bath in time depends on the way the bath is used and maintained. Therefore the temporal factor is insufficient to determine whether the plating bath solution is already worn and contaminated with degradation products to a degree affecting plating performance. A real-life industrial example supporting the above statement is presented in FIG. 11. The concentration of all of bath components (Copper Cubath SC, Enthone) in baths A and B were maintained constant over time by replenishments administered based on the bath analyses. The MD/PCA parameters were calculated from voltammograms recorded over a period of several weeks for two plating baths, A and B. These MD/PCA parameters were the measure of the accumulation of the degradation products in both baths. As it was determined empirically for that DC voltammogram of that bath, the plating performance is satisfactory as long as MD/PCA value does not exceed 6. One may notice that a regularly administered feed and bleed procedure prevents the accumulation of the degradation products over time (bath B). On the other hand, passive consumption alone is sufficient to contaminate bath with degradation products beyond acceptable limits (bath A).

EXAMPLE 16

Determinant analysis of the shapes of voltammograms can warn the plating bath operator not only about the problems in the plating solution but also about the malfunctioning of the bath analyzer itself. As long as recorded voltammograms pass the chemometric scan qualifier tests the operator is in the comfortable situation of knowing that both plating solution and the bath analyzer are performing well.

The voltammetric system can record not only the DC and AC-current components but also the potential applied to the working electrode. The differences in applied potentials among various voltammograms of the training set are minimal and so is the tolerance of the outlier detection techniques. An industrial example of faulty data acquisition causing the recorded applied potential data to be partially substituted by current data is shown in FIG. 12. The faulty data is compared to several proper potential data sets taken from the industrial training set. The range taken for outlier detection is 80–120 and number of factors equals two.

Outlier detection parameters obtained by MD/PCA, MD/PCA/R, SIMCA and $F^S$ ratio are presented in Table 7. The aforementioned low tolerance of the determinant techniques is evident in the relatively (to previous examples) low value of the maximal outlier detection parameters from the crossvalidation within the training set. Tremendous qualitative differences between outlying curves and that of the training set make the effect of Q residuals to be dominant in MD/PCA/R, SIMCA and $F^S$ ratio results.

TABLE 7

Outlier detection for industrial solutions after channel switch.

| Industrial sample | MD/PCA | MD/PCA/R | SIMCA | $F^s$ |
|---|---|---|---|---|
| 02270013.2001 | 1087.37 | 878617.16 | 893080.57 | 952619.28 |
| 03021013.2001 | 947.11 | 1649815.75 | 1677227.55 | 1789042.73 |
| Max. value for cross validation within training set | 2.4 | 2.68 | 2.01 | 2.14 |

dq21ba23, ch 1, 80–120, 2 factors; training set consists of 48 industrial scans

REFERENCES

The following background documents are cited herein. To the extent necessary for a full and complete understanding of this invention, the disclosures of these documents are hereby incorporated herein by reference:

[1] Provisional Patent Application Serial No. 60/397,120, filed Jul. 19, 2002.

[2] Donbrow, M. Stability of the Polyoxyethylene Chain, in Schick, M. J. Ed. Nonionic Surfactants. Physical Chemistry, Dekker, N.Y., 1987.

[3] Dietz, K. CircuTree, 13 (3) (2000) 54.

[4] Moffat, T. P.; Bonevich, J. E.; Huber, W. H.; Stanishevsky, A.; Kelly, D. R.; Stafford, G. R. and Josell, D.; J. Electrochem. Soc. 147 (2000) 4524.

[5] Moffat, T. P.; Wheeler D.; Huber W. H; and Josell D.; Electrochem. Solid-State Lett., 4, (2001), C26.

[6] Josell, D.; Wheeler D.; Huber W. H; and Moffat, T. P.; Phys.Rev.Lett., 87, (2001), 16102.

[7] Josell, D.; Wheeler D.; Huber W. H; Bonevich, J. E.; and Moffat, T. P.; J.Electrochem.Soc.; 148, (2001), C767

[8] Sharaf, M. H.; Illman, D. L. and Kowalski, B. R. Chemometrics, Wiley, N.Y., 1986.

[9] Geladi, P. and Kowalski, B. R. Anal. Chim. Acta 185 (1986) 1.

[10] Davis, J. C. Statistics and Data Analysis in Geology, Wiley, N.Y., 1986.

[11] Malinowski, E. R. Factor Analysis in Chemistry, $2^{nd}$ Ed., Wiley, N.Y., 1991.

[12] Wold, S.; Esbensen, K. and Geladi, P. Chemo. and Intel. Lab. Sys. 2 (1987) 37.

[13] Donahue, S. M. and Brown, C. W. Anal. Chem. 63 (1991) 980.

[14] Press, W. H.; Teukolsky, S. A.; Vetterling, W. T. and Flannery, B. P. Numerical Recipes in C. The Art of Scientific Computing, $2^{nd}$ Ed., Cambridge University Press, Cambridge, 1992.

[15] Sprott, J. H. Numerical Recipes. Routines and Examples in BASIC, Cambridge University Press, Cambridge, 1991.

[16] Martens, H. and Naes, T. Multivariate Calibration, Wiley, N.Y., 1989.

[17] Höskuldsson, A. Prediction Methods in Science and Technology, Thor Publishing, Denmark, 1996.

[18] Kramer, R. Chemometric Techniques for Quantitative Analysis, Dekker, N.Y., 1998.

[19] Haaland, D. M. and Thomas, E. V.; Anal. Chem., 60, (1988), 1193.

[20] Draper, N. R. and Smith, H. Applied Regression Analysis, $3^{rd}$ Ed., Wiley, N.Y., 1998.

[21] Dietz, K.; CircuTree, 13 (2) (2000) 22.

[22] Shah, N. K. and Gemperline, P. J.; Anal. Chem., 62, (1992), 465.

The present invention has been described in detail, including the preferred embodiments thereof. However, it will be appreciated that those skilled in the art, upon consideration of the present disclosure, may make modifications and/or improvements on this invention and still be within the scope of this invention as set forth in the following claims.

The invention claimed is:

1. A process to produce a predictive data set which can be used to predict the property of a plating solution, said process comprising:

(a) obtaining a sample set, wherein each sample comprises a plating solution of good performance;

(b) obtaining an electroanalytical response for each said sample to produce a electroanalytical response data set;

(c) obtaining a training set that comprises said sample set and corresponding said electroanalytical response data set;

(d) analyzing said training set using decomposition method coupled with discriminant analysis method to produce a discriminant parameters data set; and (e) validating said training data set to produce said predictive data set for a predictive model.

2. A process of claim 1 wherein said property is selected from the group consisting of:

a concentration of individual component of said electroplating bath;

an amount of breakdown products accumulated in said electroplating bath;

an amount of foreign contaminants accumulated in said electroplating bath;

a temperature of said electroplating bath;

a quantity of hysteresis on recorded voltammogram;

or combinations thereof.

3. A process of claim 1, wherein said property comprises an overall plating performance.

4. A process of claim 3, wherein said overall plating performance is selected from the group consisting of:

throwing power;

brightness of the deposit;

tensile strengths of the deposit;

ductility of the deposit;

internal stress of the deposit;

solderability performance;

resistance to thermal shock;

uniformity of the deposit;

capability of uniform filling through holes;

capability of filling submicron features in a substrate surface;

or combinations thereof.

5. A process according to claim 1, wherein said plating solution is an electroplating bath.

6. A process of claim 5, wherein said electroplating bath comprises a plating bath of one or more metals selected from the group consisting of: Cu, Sn, Pb, Zn, Ni, Ag, Cd, Co, Cr, and/or their alloys.

7. A process according to claim 1, wherein said plating solution is an electroless plating bath.

8. A process of claim 7, wherein said electroless plating bath comprises an autocatalytic plating bath of one or more metals selected from the group consisting of: Cu, Sn, Pb, Ni, Ag, Au, and/or their alloys.

9. A process of claim 7, wherein said electroless plating bath comprises an immersion plating bath of one or more metals selected from the group consisting: Cu, Sn, Pb, Ni, Ag, Au and/or their alloys.

10. A process according to claim 1, wherein said plating solution is selected from the group consisting of:

an electrowinning bath;
an electrorefining bath;
an electropolishing bath;
an electroforming bath; or
an electromicromachining bath.

11. A process of claims 10, wherein said electroplating bath comprises a plating bath of one or more metals selected from the group consisting of: Cu, Sn, Pb, Zn, Ni, Ag, Cd, Co, Cr, and/or their alloys.

12. A process of claim 1, wherein the sample set of step (a) comprises plating solutions of known concentration within specification range.

13. A process according to claim 1, wherein the sample data set of step (a) is obtained by design of experiment (DOE) routines.

14. A process according to claim 13, wherein said DOE routine is multicomponent multilevel linear orthogonal array.

15. A process according to claim 13, wherein said DOE routine is multicomponent multilevel fractional factorial.

16. A process of claim 1, wherein the sample set of step (a) comprises freshly prepared electroplating solutions of known concentration within specification range.

17. A process of claim 1, wherein said sample set of step (a) comprises industrial plating solutions with well known performance, empirical sample set.

18. A process to produce a predictive data set which can be used to predict the property of a plating solution, said process comprising:

(a) obtaining a sample set, wherein each sample comprises a plating solution of good performance;
(b) obtaining an electroanalytical response for each said sample to produce a electroanalytical response data set;
(c) obtaining a training set that comprises said sample set and corresponding said electroanalytical response data set;
(d) analyzing said training set using decomposition method coupled with discriminant analysis method to produce a discriminant parameters data set; and
(e) validating said training data set to produce said predictive data set for a predictive model, wherein the electroanalytical response of step (b) is obtained by DC Voltammetry.

19. A process of claim 18, wherein the DC Voltammetry comprises DC cyclic Voltammetry.

20. A process of claim 18, wherein the DC Voltammetry comprises DC Linear Scan Voltammetry.

21. A process of claim 18, wherein the DC Voltammetry comprises DC Anodic Stripping Voltammetry.

22. A process of claim 18, wherein the DC Voltammetry comprises DC Cathodic Stripping Voltammetry.

23. A process of claim 18, wherein the DC Voltammetry comprises DC Adsorptive Stripping Voltammetry.

24. A process of claim 19, wherein the DC Voltammetry comprises DC Cyclic Voltammetric Stripping technique.

25. A process according to claim 1, wherein the electroanalytical response of step (b) is obtained by a technique selected from the group consisting of:

DC Staircase Voltammetry;
Normal Pulse Voltammetry;
Reverse Pulse Voltammetry;
Differential Pulse Voltammetry;
Square Wave Voltammetry;
AC Voltammetry;
Chronoamperometry;
Chronopotentiometry;
Electrochemical Impedance Spectroscopy technique;
Polarographic techniques;
or combinations thereof.

26. A process according to claim 1, wherein said electroanalytical response of step (b) comprises a plurality of data points.

27. A process according to claim 1, wherein said electroanalytical response of step (b) is a combination of one or more portions of a complete electroanalytical response.

28. A process according to claim 1, wherein said electroanalytical response of step (b) comprises a combination of one or more portions of independent electroanalytical responses.

29. A process of claim 1, wherein said decomposition method of step (d) is selected from the group of:

Principal Component Analysis (PCA);
calculation of Mahalanobis Distance (MD);
calculation of Mahalanobis Distance with residuals (MDR);
calculation by Simple Modeling of Class Analogy (SIMCA);
calculation of $F^s$ ratio;
internal validation;
external validation;
and combinations thereof.

30. A process to predict the property of a plating solution, said process comprising:

(a) producing a predictive data set, the predictive data set generated by:
(a1) obtaining a sample set, wherein each sample comprises an electrolyte solution of good performance;
(a2) obtaining an electroanalytical response for each said sample to produce an electroanalytical response data set;
(a3) obtaining a training set that comprises said sample set and corresponding said electroanalytical response data set;
(a4) preprocessing of said electroanalytical response data set;
(a5) analyzing said training set using decomposition method coupled with discriminant analysis method to produce a discriminant parameters data set;
(a6) validating said training data set to produce said predictive data set for a predictive model; and
(b) using said predictive data set to predict the property of said plating solution, said property predicted by:
(b1) obtaining an unknown sample set, wherein each unknown sample in said unknown sample set contains a plating solution;
(b2) obtaining an electroanalytical response for each said unknown sample to produce an electroanalytical response data set;
(b3) preprocessing of said electroanalytical response data set; and
(b4) applying said predictive model to predict property of each said unknown sample.

31. A process to detect faulty performance of a plating solution, said process comprising:

(a) producing a predictive data set, the predictive data set generated by:
(a1) obtaining a sample set, wherein each sample comprises an electrolyte solution of good performance;
(a2) obtaining an electroanalytical response for each said sample to produce an electroanalytical response data set;

(a3) obtaining a training set that comprises said sample set and corresponding said electroanalytical response data set;

(a4) preprocessing of said electroanalytical response data set;

(a5) analyzing said training set using decomposition method coupled with discriminant analysis method to produce a discriminant parameters data set;

(a6) validating said training data set to produce said predictive data set for a predictive model; and (a7) specifying the limits of good and faulty performance of said plating solution; and (b) using said predictive data set to predict the property of said plating solution and qualify said solution as correct or faulty said process comprises:

(b1) obtaining an unknown sample set, wherein each unknown sample in said unknown sample set contains a plating solution;

(b2) obtaining an electroanalytical response for each said unknown sample to produce an electroanalytical response data set;

(b3) preprocessing of said electroanalytical response data set;

(b4) applying said predictive model to predict property of each said unknown sample; and (b5) qualifying said unknown samples as correct or faulty.

32. A method of monitoring performance of plating solution in order to perform controlled feed and bleed procedure, said process comprising the steps of:

(a) producing a predictive data set, the predictive data set generated by:

(a1) obtaining a sample set, wherein each sample comprises an electrolyte solution of good performance;

(a2) obtaining an electroanalytical response for each said sample to produce an electroanalytical response data set;

(a3) obtaining a training set that comprises said sample set and corresponding said electroanalytical response data set;

(a4) preprocessing of said electroanalytical response data set;

(a5) analyzing said training set using decomposition method coupled with discriminant analysis method to produce a discriminant parameters data set;

(a6) validating said training data set to produce said predictive data set for a predictive model;

(a7) defining the limits of said property for said plating solution that requires feed and bleed procedure; and (b) using said predictive data set to predict the property of said plating solution and qualify said solution as correct or faulty said process comprises:

(b1) obtaining an unknown sample set, wherein each unknown sample in said unknown sample set contains a plating solution;

(b2) obtaining an electroanalytical response for each said unknown sample to produce an electroanalytical response data set;

(b3) preprocessing of said electroanalytical response data set;

(b4) applying said predictive model to predict property of each said unknown sample; and (b5) qualifying said unknown samples as a ready or not ready solution for feed and bleed procedure.

33. A method of monitoring performance of electroplating solution in order to perform controlled purification treatment procedure, said process comprising the steps of:

(a) producing a predictive data set, the predictive data set generated by:

(a1) obtaining a sample set, wherein each sample comprises an electrolyte solution of good performance;

(a2) obtaining an electroanalytical response for each said sample to produce an electroanalytical response data set;

(a3) obtaining a training set that comprises said sample set and corresponding said electroanalytical response data set;

(a4) preprocessing of said electroanalytical response data set;

(a5) analyzing said training set using decomposition method coupled with discriminant analysis method to produce a discriminant parameters data set;

(a6) validating said training data set to produce said predictive data set for a predictive model; and (a7) defining the limits of said property for said plating solution that requires purification treatment; and (b) using said predictive data set to predict the property of said plating solution and qualify said solution as correct or faulty said process comprises:

(b1) obtaining an unknown sample set, wherein each unknown sample in said unknown sample set contains a plating solution;

(b2) obtaining an electroanalytical response for each said unknown sample to produce an electroanalytical response data set;

(b3) preprocessing of said electroanalytical response data set;

(b4) applying said predictive model to predict property of each said unknown sample; and (b5) qualifying said unknown samples as ready or not ready for purification treatment.

* * * * *

UNITED STATES PATENT AND TRADEMARK OFFICE

CERTIFICATE OF CORRECTION

PATENT NO. : 7,124,120 B2 
APPLICATION NO. : 10/621079
DATED : October 17, 2006
INVENTOR(S) : Kazimierz J. Wikiel, Aleksander Jaworski and Hanna Wikiel It is certified that error appears in the above-identified patent and that said Letters Patent is hereby corrected as shown below:

On Title page item 56

At page 1, right-hand column, in the first publication listed under Other Publications, please replace "'Artificial Nerrral Networks'" with --'Artificial Neural Networks'--.

On Title page, item 56
At page 2, right-hand column, in the third publication listed under Other Publications, please replace "Sumbicron" with --Submicron--; in the fourth publication, please replace "Sumbmicrometer" with --Submicrometer--.

Column 10, lines 5-7, please replace the equation "$s_{u=xu}V$" with --$s_u=x_uV$--.

Column 10, lines 36-41, please replace the equation " $rs_i = \sum_{j=1}^{n}(x_{i,j} - x_{i,j})^2$ " with -- $rs_i = \sum_{j=1}^{n}(\hat{x}_{i,j} - x_{i,j})^2$ --.

Column 11, lines 30-32, please replace the equation "$D_u^{2=s}{}_uM^{-1}s_u^T$" with --$D_u^2 = s_uM^{-1}s_u^T$--.

Column 12, lines 50-54, please replace the equation "$Dr_u^{2=t}{}_uMr^{-1}t_u^T$" with --$Dr_u^2 = t_uMr^{-1}t_u^T$--.

Signed and Sealed this

Second Day of January, 2007

JON W. DUDAS
*Director of the United States Patent and Trademark Office*